US010157566B2

(12) United States Patent
Kim et al.

(10) Patent No.: US 10,157,566 B2
(45) Date of Patent: Dec. 18, 2018

(54) DISPLAY DRIVING DEVICE AND DISPLAY DEVICE HAVING THE SAME

(71) Applicant: SAMSUNG ELECTRONICS CO., LTD., Swuon-si (KR)

(72) Inventors: Yong-Hun Kim, Seoul (KR); Hyun-Sang Park, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 17 days.

(21) Appl. No.: 15/446,542

(22) Filed: Mar. 1, 2017

(65) Prior Publication Data

US 2017/0256194 A1 Sep. 7, 2017

(30) Foreign Application Priority Data

Mar. 4, 2016 (KR) ..... 10-2016-0026624
Jul. 25, 2016 (KR) ..... 10-2016-0094024

(51) Int. Cl.
*G09G 3/20* (2006.01)
*G09G 3/36* (2006.01)

(52) U.S. Cl.
CPC ..... *G09G 3/2092* (2013.01); *G09G 3/3614* (2013.01); *G09G 3/3688* (2013.01); *G09G 2310/0275* (2013.01); *G09G 2310/0291* (2013.01); *G09G 2310/0297* (2013.01); *G09G 2320/0271* (2013.01); *G09G 2320/0673* (2013.01); *G09G 2330/021* (2013.01); *G09G 2360/16* (2013.01)

(58) Field of Classification Search
None
See application file for complete search history.

(56) References Cited

U.S. PATENT DOCUMENTS 6,249,270 B1 * 6/2001 Ito ..... G09G 3/3688 345/100
7,190,357 B2 3/2007 Ohta et al.
9,024,920 B2 5/2015 Kojima et al.
2009/0153593 A1 * 6/2009 Lee ..... G09G 3/3688 345/690
2011/0273425 A1 * 11/2011 Kojima ..... G09G 3/3291 345/211
2012/0126712 A1 5/2012 Kim
(Continued)

FOREIGN PATENT DOCUMENTS

JP 201159706 A 3/2011
KR 1020000003732 A 1/2000
(Continued)

*Primary Examiner* — Christopher J Kohlman
(74) *Attorney, Agent, or Firm* — Sughrue Mion, PLLC

(57) ABSTRACT

A display driving device includes a timing controller, a power management integrated circuit, and a column driver. The timing controller generates image data including a plurality of pixel data, and generates a power saving signal based on magnitudes of the plurality of pixel data included in the image data. The power management integrated circuit generates a drive voltage having a voltage level that is varied based on the power saving signal. The column driver receives the image data generated by the timing controller, and generates a plurality of output voltages corresponding to the plurality of pixel data included in the image data based on the drive voltage.

17 Claims, 14 Drawing Sheets

(56) References Cited

U.S. PATENT DOCUMENTS

| | | | | |
|---|---|---|---|---|
| 2014/0285535 | A1* | 9/2014 | Pyo | G09G 3/3291 345/690 |
| 2015/0002503 | A1* | 1/2015 | Park | G09G 3/3696 345/212 |
| 2016/0042687 | A1 | 2/2016 | Jeong et al. | |

FOREIGN PATENT DOCUMENTS

| | | | |
|---|---|---|---|
| KR | 101373335 | B1 | 3/2014 |
| KR | 1020140076826 | A | 6/2014 |
| KR | 101520687 | B1 | 5/2015 |

* cited by examiner

FIG. 12A

FRAME P

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 12B

FRAME (P+1)

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

DISPLAY DRIVING DEVICE AND DISPLAY DEVICE HAVING THE SAME

CROSS-REFERENCE TO RELATED APPLICATION(S)

This application claims priority from Korean Patent Application No. 10-2016-0026624, filed on Mar. 4, 2016, and Korean Patent Application No. 10-2016-0094024, filed on Jul. 25, 2016, the contents of which are herein incorporated by reference in their entirety.

BACKGROUND

1. Technical Field

Example embodiments relate to a display device, and more particularly to a display driving device included in a display device that decreases power consumption.

2. Description of the Related Art

As a resolution of a display device increases, power consumption of a display driving device, which drives a display panel, increases.

Therefore, in an electronic device such as a mobile device which operates using a battery, decreasing power consumption is very important to increase a usable time of the mobile device with the battery.

However, if a separate device for decreasing power consumption is implemented in the display driving device, a size of the display device including the display driving device increases.

SUMMARY

One or more example embodiments are directed to provide a display driving device that decreases power consumption without increasing a size.

One or more example embodiments are directed to provide a display device including the display driving device.

According to an aspect of example embodiments, a display driving device includes a timing controller, a power management integrated circuit, and a column driver. The timing controller generates image data including a plurality of pixel data, and generates a power saving signal based on magnitudes of the plurality of pixel data included in the image data. The power management integrated circuit generates a drive voltage having a voltage level that is varied based on the power saving signal. The column driver receives the image data generated by the timing controller and the drive voltage generated by the power management integrated circuit, and generates a plurality of output voltages corresponding to the plurality of pixel data included in the image data based on the drive voltage.

According to an aspect of example embodiments, a display driving device includes a timing controller, a power management integrated circuit, and a column driver. The timing controller generates image data including a plurality of pixel data, generates a positive power saving signal based on magnitudes of positive polarity pixel data among the plurality of pixel data included in the image data, and generates a negative power saving signal based on magnitudes of negative polarity pixel data among the plurality of pixel data included in the image data. The power management integrated circuit generates a positive drive voltage having a voltage level that is varied based on the positive power saving signal, and generates a negative drive voltage having a voltage level that is varied based on the negative power saving signal. The column driver receives the image data generated by the timing controller and the positive drive voltage and the negative drive voltage generated by the power management integrated circuit, generates a plurality of positive output voltages corresponding to the positive polarity pixel data included in the image data based on the positive drive voltage, and generates a plurality of negative output voltages corresponding to the negative polarity pixel data included in the image data based on the negative drive voltage.

According to an aspect of example embodiments, a display device includes a display panel configured to display an image; and a display driving device configured to drive the display panel and coupled to the display panel via data lines and gate lines. The display driving device includes a column driver configured to generate output voltages corresponding to pixel data included in image data and to output the output voltages via the data lines, wherein the output voltages are varied according to a maximum magnitude of the pixel data included in the image data; and a gate driver configured to select and drive the gate lines.

BRIEF DESCRIPTION OF THE DRAWINGS

The above and other aspects will be more clearly understood from the following detailed description of illustrative, non-limiting example embodiments, in conjunction with the accompanying drawings:

FIGS. 12A and 12B are diagrams for describing an inversion driving scheme of the display device of FIG. 11 according to an example embodiment;

DETAILED DESCRIPTION

Figure 1:
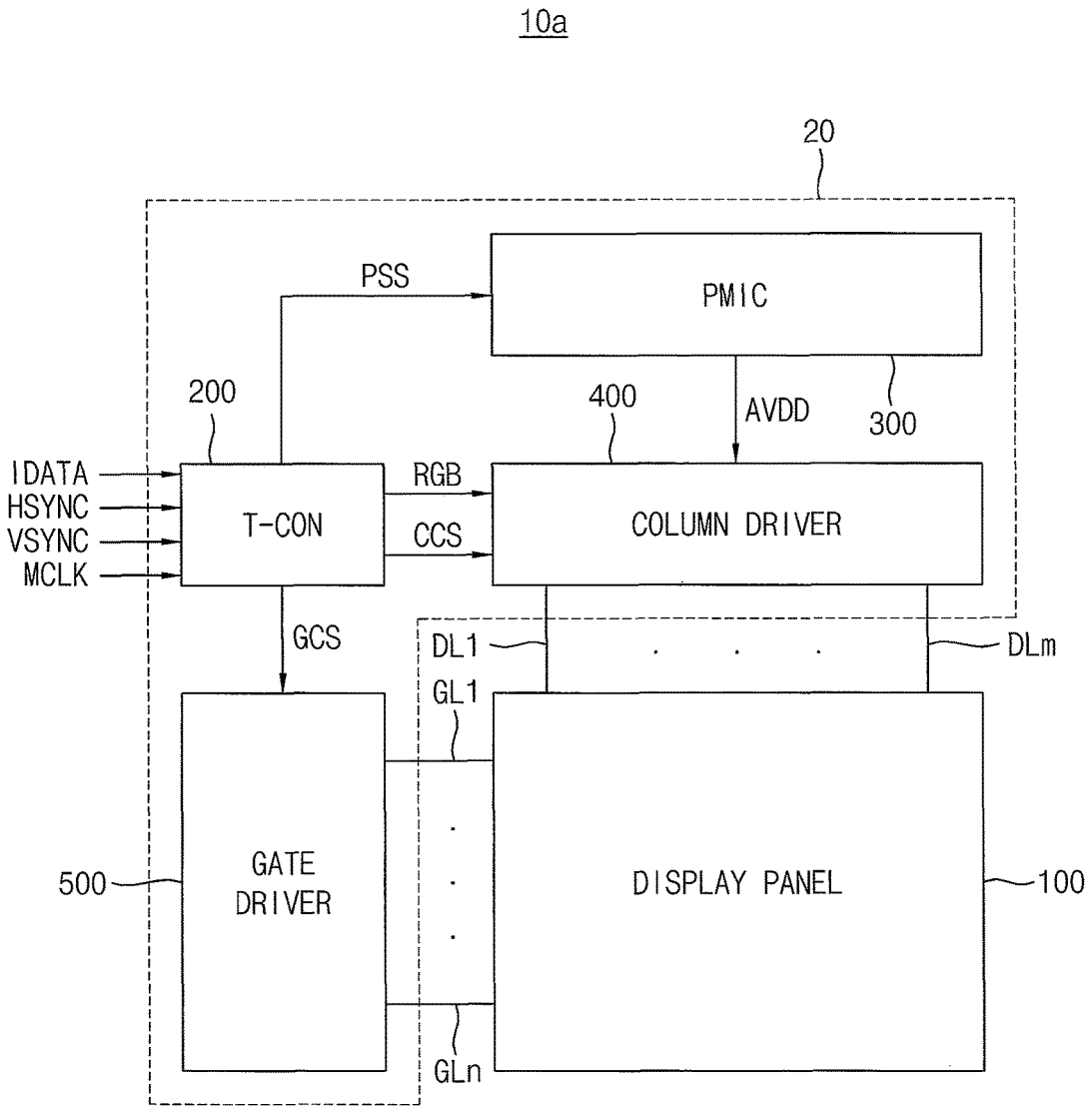
FIG. 1 is a block diagram illustrating a display device according to example embodiments.

FIG. 1 is a block diagram illustrating a display device according to example embodiments.

Referring to FIG. 1, a display device 10*a* includes a display panel 100 and a display driving device 20.

The display panel 100 may include red pixels, green pixels, and blue pixels coupled to a plurality of gate lines GL1~GLn and a plurality of data lines DL1~DLm. Here, n and m represent positive integers.

The display driving device 20 may include a timing controller (T_CON) 200, a power management integrated circuit (PMIC) 300, a column driver 400, and a gate driver 500.

In some example embodiments, the timing controller 200 and the column driver 400 may be included in separate integrated circuits.

The timing controller 200 may receive input data IDATA, a horizontal synchronization signal HSYNC, a vertical synchronization signal VSYNC, and a main clock signal MCLK from a host. The timing controller 200 may generate a gate control signal GCS and a column control signal CCS based on the horizontal synchronization signal HSYNC, the vertical synchronization signal VSYNC, and the main clock signal MCLK.

In addition, the timing controller 200 may divide the input data IDATA in a unit of a frame based on the vertical synchronization signal VSYNC, and divide the input data IDATA in a unit of a line based on the horizontal synchronization signal HSYNC to generate image data RGB. Therefore, the image data RGB may include a plurality of pixel data corresponding to a plurality of pixels disposed in a same line. For example, the image data RGB may include red pixel data, green pixel data, and blue pixel data corresponding to red pixels, green pixels, and blue pixels disposed in a same line.

The timing controller 200 may generate a power saving signal PSS based on magnitudes of the plurality of pixel data included in the image data RGB and a reference magnitude. The timing controller 200 may provide the power saving signal PSS to the power management integrated circuit 300.

The power management integrated circuit 300 may generate a drive voltage AVDD having a voltage level varied based on the power saving signal PSS, and provide the drive voltage AVDD to the column driver 400.

In some example embodiments, the timing controller 200 may deactivate the power saving signal PSS when a maximum magnitude of the plurality of pixel data included in the image data RGB is equal to or greater than the reference magnitude, and activate the power saving signal PSS when the maximum magnitude of the plurality of pixel data included in the image data RGB is smaller than the reference magnitude.

In this case, the power management integrated circuit 300 may generate the drive voltage AVDD having a first voltage level when the power saving signal PSS is deactivated, and generate the drive voltage AVDD having a second voltage level lower than the first voltage level when the power saving signal PSS is activated.

In other example embodiments, the timing controller 200 may compare the maximum magnitude of the plurality of pixel data included in the image data RGB with each of first through t-th reference magnitudes to generate the power saving signal PSS having one of first through (t+1)-th values. Here, t represents an integer equal to or greater than 2.

In this case, the power management integrated circuit 300 may generate the drive voltage AVDD having a voltage level proportional to the value of the power saving signal PSS.

The timing controller 200 may provide the gate control signal GCS to the gate driver 500, and provide the column control signal CCS and the image data RGB to the column driver 400.

The gate driver 500 may be coupled to the display panel 100 through the plurality of gate lines GL1~GLn. The gate driver 500 may consecutively select and drive the plurality of gate lines GL1~GLn based on the gate control signal GCS.

The column driver 400 may be coupled to the display panel 100 through the plurality of data lines DL1~DLm. The column driver 400 may generate a plurality of output voltages corresponding to the plurality of pixel data included in the image data RGB by processing the image data RGB using the drive voltage AVDD based on the column control signal CCS, and provide the plurality of output voltages to the display panel 100 through the plurality of data lines DL1~DLm.

For example, the column driver 400 may generate a red output voltage corresponding to the red pixel data, a green output voltage corresponding to the green pixel data, and a blue output voltage corresponding to the blue pixel data, and provide the red output voltage, the green output voltage, and the blue output voltage to the red pixel, the green pixel, and the blue pixel of the display panel 100, respectively, through the plurality of data lines DL1~DLm.

In some example embodiments, the display panel 100 may be driven by the display driving device 20 in a non-inversion scheme. For example, the display panel 100 may correspond to an organic light emitting diode (OLED) display panel. In this case, the plurality of output voltages provided by the display driving device 20 to the display panel 100 may always have a positive polarity.

As described above, when the maximum magnitude of the plurality of pixel data included in the image data RGB is relatively great (e.g., greater than a reference value), the column driver 400 may generate the output voltage having a relatively high voltage level. On the other hand, when the maximum magnitude of the plurality of pixel data included in the image data RGB is relatively small (e.g., less than a reference value), the column driver 400 may generate the output voltage having a relatively low voltage level.

Therefore, when the maximum magnitude of the plurality of pixel data included in the image data RGB is relatively great, the power management integrated circuit 300 included in the display driving device 20 according to example embodiments may provide the drive voltage AVDD having a relatively high voltage level to the column driver 400 during a horizontal period in which the plurality of output voltages corresponding to the image data RGB are provided to the display panel 100. On the other hand, when the maximum magnitude of the plurality of pixel data included in the image data RGB is relatively small, the power management integrated circuit 300 included in the display driving device 20 according to example embodiments may decrease a voltage level of the drive voltage AVDD to provide the drive voltage AVDD having a relatively low voltage level to the column driver 400 during a horizontal period in which the plurality of output voltages corresponding to the image data RGB are provided to the display panel 100.

Since power consumption of the display driving device 20 decreases as the voltage level of the drive voltage AVDD decreases, the display driving device 20 according to example embodiments may effectively decrease power consumption without a separate device for decreasing power consumption.

Figure 2:
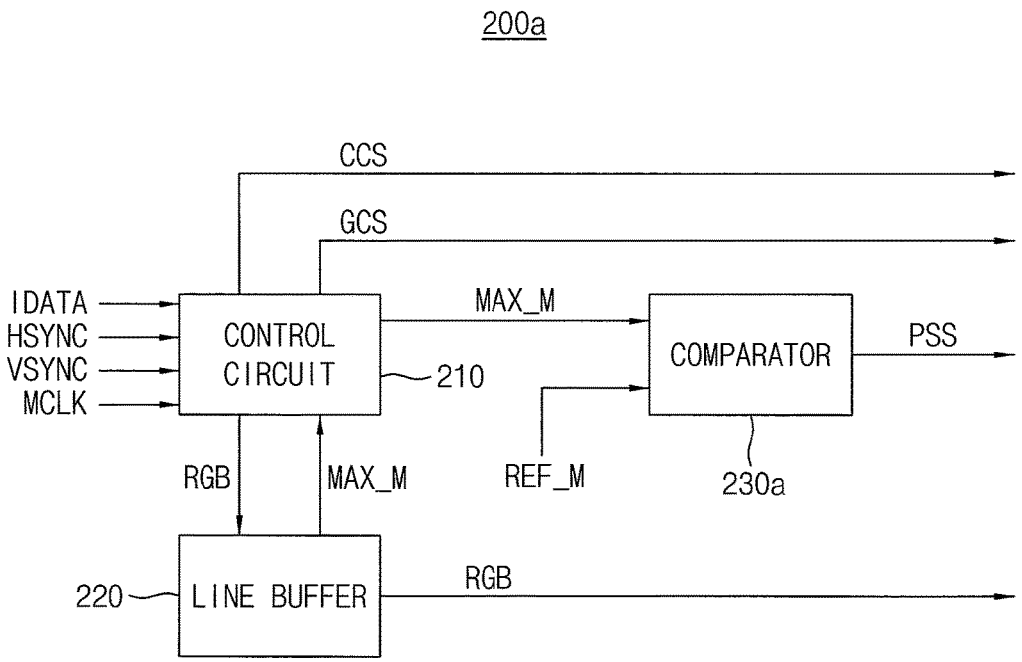
FIG. 2 is a block diagram illustrating a timing controller included in the display device of FIG. 1 according to an example embodiment.

FIG. 2 is a block diagram illustrating a timing controller included in the display device of FIG. 1 according to an example embodiment.

Referring to FIG. 2, a timing controller 200*a* may include a control circuit 210, a line buffer 220, and a comparator 230*a*.

The control circuit 210 may receive the input data IDATA, the horizontal synchronization signal HSYNC, the vertical synchronization signal VSYNC, and the main clock signal MCLK from the host. The control circuit 210 may generate the gate control signal GCS and the column control signal CCS based on the horizontal synchronization signal HSYNC, the vertical synchronization signal VSYNC, and the main clock signal MCLK. In addition, the control circuit 210 may divide the input data IDATA in a unit of a frame based on the vertical synchronization signal VSYNC, and divide the input data IDATA in a unit of a line based on the horizontal synchronization signal HSYNC to generate the image data RGB including the plurality of pixel data corresponding to one line. The control circuit 210 may store the image data RGB including the plurality of pixel data corresponding to one line in the line buffer 220.

The image data RGB stored in the line buffer 220 may be provided to the column driver 400.

The control circuit 210 may provide a maximum magnitude MAX_M of the plurality of pixel data stored in the line buffer 220 to the comparator 230*a*.

The comparator 230*a* may compare the maximum magnitude MAX_M with the reference magnitude REF_M to generate the power saving signal PSS.

In some example embodiments, the comparator 230*a* may deactivate the power saving signal PSS when the maximum magnitude MAX_M is equal to or greater than the reference magnitude REF_M, and activate the power saving signal PSS when the maximum magnitude MAX_M is smaller than the reference magnitude REF_M.

In this case, the power management integrated circuit 300 may generate the drive voltage AVDD having the first voltage level when the power saving signal PSS is deactivated, and generate the drive voltage AVDD having the second voltage level lower than the first voltage level when the power saving signal PSS is activated.

In some example embodiments, the reference magnitude REF_M may be stored in the timing controller 200*a*. In other example embodiments, the reference magnitude REF_M may be provided by the host.

Figure 3:
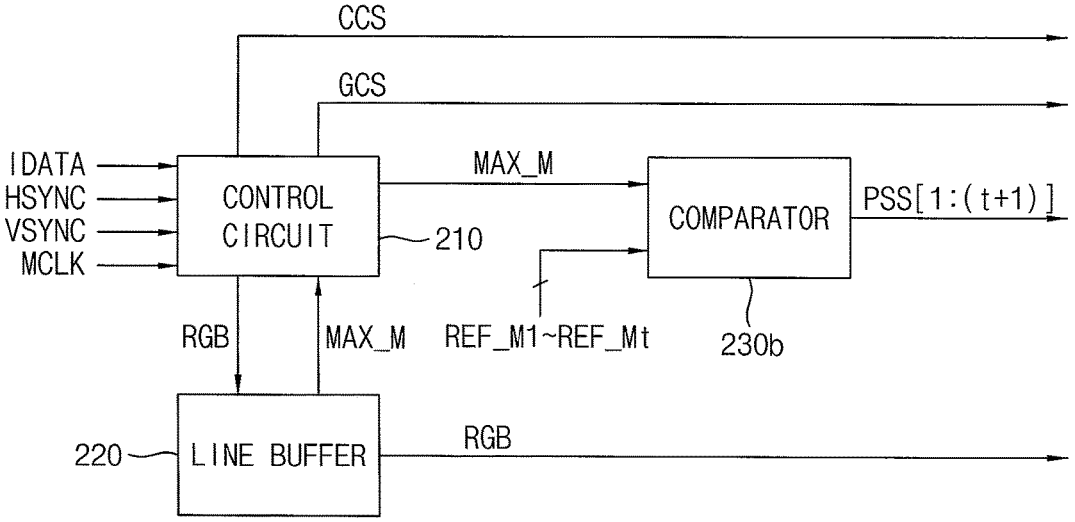
FIG. 3 is a block diagram illustrating a timing controller included in the display device of FIG. 1 according to another example embodiment.

FIG. 3 is a block diagram illustrating a timing controller included in the display device of FIG. 1 according to another example embodiment.

Referring to FIG. 3, a timing controller 200*b* may include a control circuit 210, a line buffer 220, and a comparator 230*b*.

The control circuit 210 and the line buffer 220 included in the timing controller 200*b* of FIG. 3 are the same as the control circuit 210 and the line buffer 220 included in the timing controller 200*a* of FIG. 2, respectively. Therefore, duplicated descriptions about the control circuit 210 and the line buffer 220 included in the timing controller 200*b* of FIG. 3 will be omitted here.

The comparator 230*b* may compare the maximum magnitude MAX_M with each of the first through t-th reference magnitudes REF_M1~REF_Mt to generate the power saving signal PSS[1:(t+1)] having one of the first through (t+1)-th values.

For example, the comparator 230*b* may generate the power saving signal PSS[1:(t+1)] having a value that increases as the maximum magnitude MAX_M increases.

In this case, the power management integrated circuit 300 may generate the drive voltage AVDD having a voltage level proportional to the value of the power saving signal PSS[1:(t+1)].

In some example embodiments, the first through t-th reference magnitudes REF_M1~REF_Mt may be stored in the timing controller 200*b*. In other example embodiments, the first through t-th reference magnitudes REF_M1~REF_Mt may be provided by the host.

Figure 4:
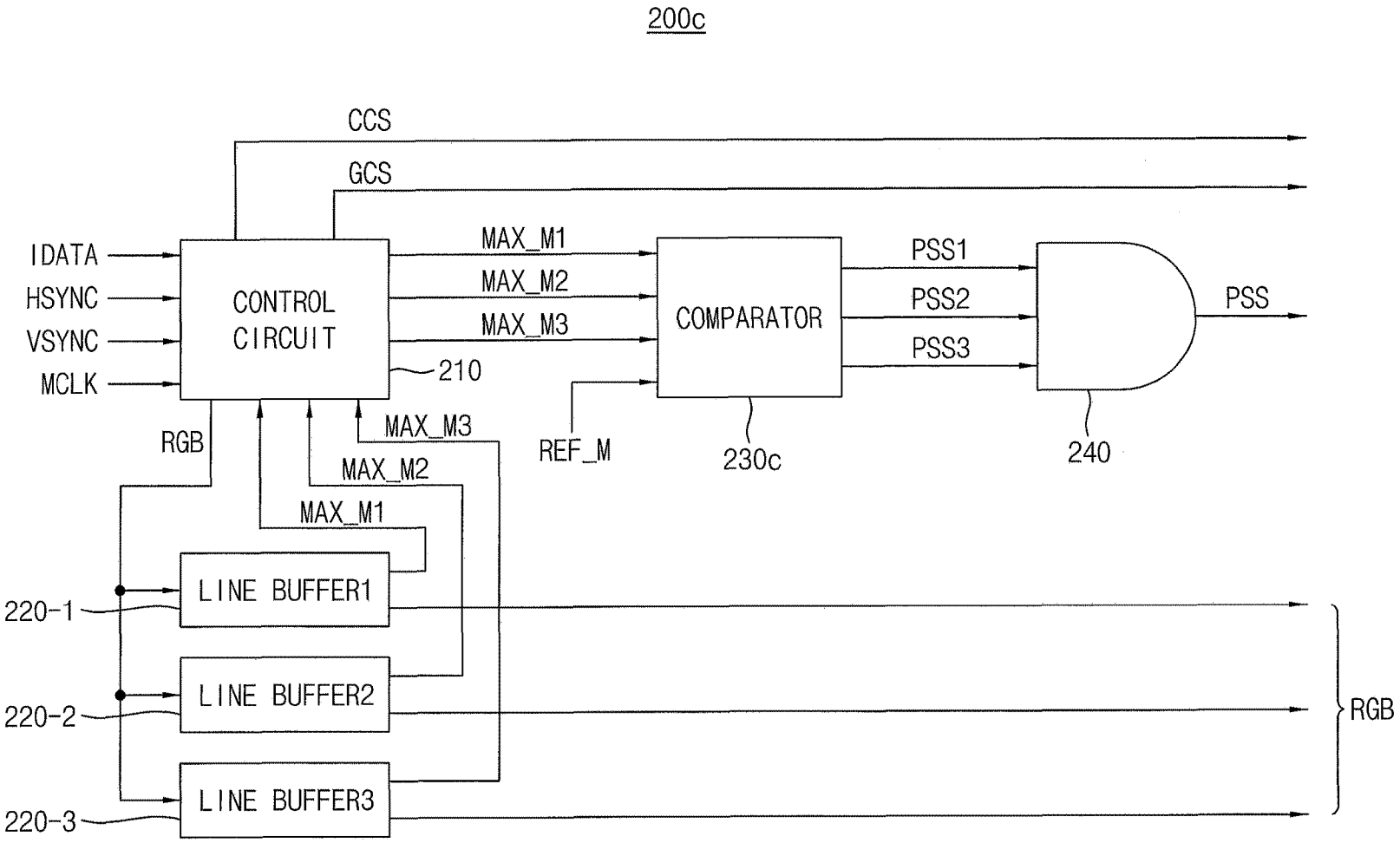
FIG. 4 is a block diagram illustrating a timing controller included in the display device of FIG. 1 according to another example embodiment.

FIG. 4 is a block diagram illustrating a timing controller included in the display device of FIG. 1 according to another example embodiment.

Referring to FIG. 4, a timing controller 200*c* may include a control circuit 210, first through third line buffers 220-1, 220-2, and 220-3, a comparator 230*c*, and an AND gate 240.

The control circuit 210 may receive the input data IDATA, the horizontal synchronization signal HSYNC, the vertical synchronization signal VSYNC, and the main clock signal MCLK from the host. The control circuit 210 may generate the gate control signal GCS and the column control signal CCS based on the horizontal synchronization signal HSYNC, the vertical synchronization signal VSYNC, and the main clock signal MCLK. In addition, the control circuit 210 may divide the input data IDATA in a unit of a frame based on the vertical synchronization signal VSYNC, and divide the input data IDATA in a unit of a line based on the horizontal synchronization signal HSYNC to generate the image data RGB including the plurality of pixel data corresponding to one line.

The control circuit 210 may consecutively store the image data RGB including the plurality of pixel data corresponding to one line in the first through third line buffers 220-1, 220-2, and 220-3. Therefore, the plurality of pixel data corresponding to consecutive first through third lines may be stored in the first through third line buffers 220-1, 220-2, and 220-3, respectively.

The image data RGB stored in the first through third line buffers 220-1, 220-2, and 220-3 may be provided to the column driver 400 consecutively.

Although the timing controller 200*c* is illustrated in FIG. 4 to include three line buffers 220-1, 220-2, and 220-3, example embodiments are not limited thereto. According to example embodiments, the timing controller 200*c* may include any number of line buffers. [70] The control circuit 210 may provide first through third maximum magnitudes MAX_M1, MAX_M2, and MAX_M3 of the plurality of pixel data stored in the first through third line buffers 220-1, 220-2, and 220-3, respectively, to the comparator 230*c*.

The comparator 230*c* may compare each of the first through third maximum magnitudes MAX_M1, MAX_M2, and MAX_M3 with the reference magnitude REF_M to generate first through third power saving signals PSS1, PSS2, and PSS3.

In some example embodiments, the comparator 230*c* may deactivate the first power saving signal PSS1 when the first maximum magnitude MAX_M1 is equal to or greater than the reference magnitude REF_M, and activate the first power saving signal PSS1 when the first maximum magnitude MAX_M1 is smaller than the reference magnitude REF_M.

Similarly, the comparator 230*c* may deactivate the second power saving signal PSS2 when the second maximum magnitude MAX_M2 is equal to or greater than the reference magnitude REF_M, and activate the second power saving signal PSS2 when the second maximum magnitude MAX_M2 is smaller than the reference magnitude REF_M.

Similarly, the comparator 230*c* may deactivate the third power saving signal PSS3 when the third maximum magnitude MAX_M3 is equal to or greater than the reference magnitude REF_M, and activate the third power saving signal PSS3 when the third maximum magnitude MAX_M3 is smaller than the reference magnitude REF_M.

The AND date 240 may perform an AND operation on the first through third power saving signals PSS1, PSS2, and PSS3 to generate the power saving signal PSS.

For example, the AND date 240 may activate the power saving signal PSS when all of the first through third power saving signals PSS1, PSS2, and PSS3 are activated, and deactivate the power saving signal PSS when at least one of the first through third power saving signals PSS1, PSS2, and PSS3 is deactivated.

In this case, the power management integrated circuit 300 may generate the drive voltage AVDD having the first voltage level when the power saving signal PSS is deactivated, and generate the drive voltage AVDD having the second voltage level lower than the first voltage level when the power saving signal PSS is activated.

Since the power management integrated circuit 300 sets a voltage level of the drive voltage AVDD using a charge pump, the power consumption of the display driving device 20 may increase when a voltage level of the drive voltage AVDD is changed frequently.

As described above with reference to FIG. 4, the timing controller 200*c* included in the display driving device 20 according to example embodiments may activate the power saving signal PSS only when a maximum magnitude of the plurality of pixel data included in each of a plurality of consecutive lines is smaller than the reference magnitude REF_M.

Therefore, the number of the line buffers included in the timing controller 200*c* may be determined based on both an increase of the power consumption caused by a voltage level change of the drive voltage AVDD and a decrease of the power consumption caused by decreasing the voltage level of the drive voltage AVDD.

Figure 5:
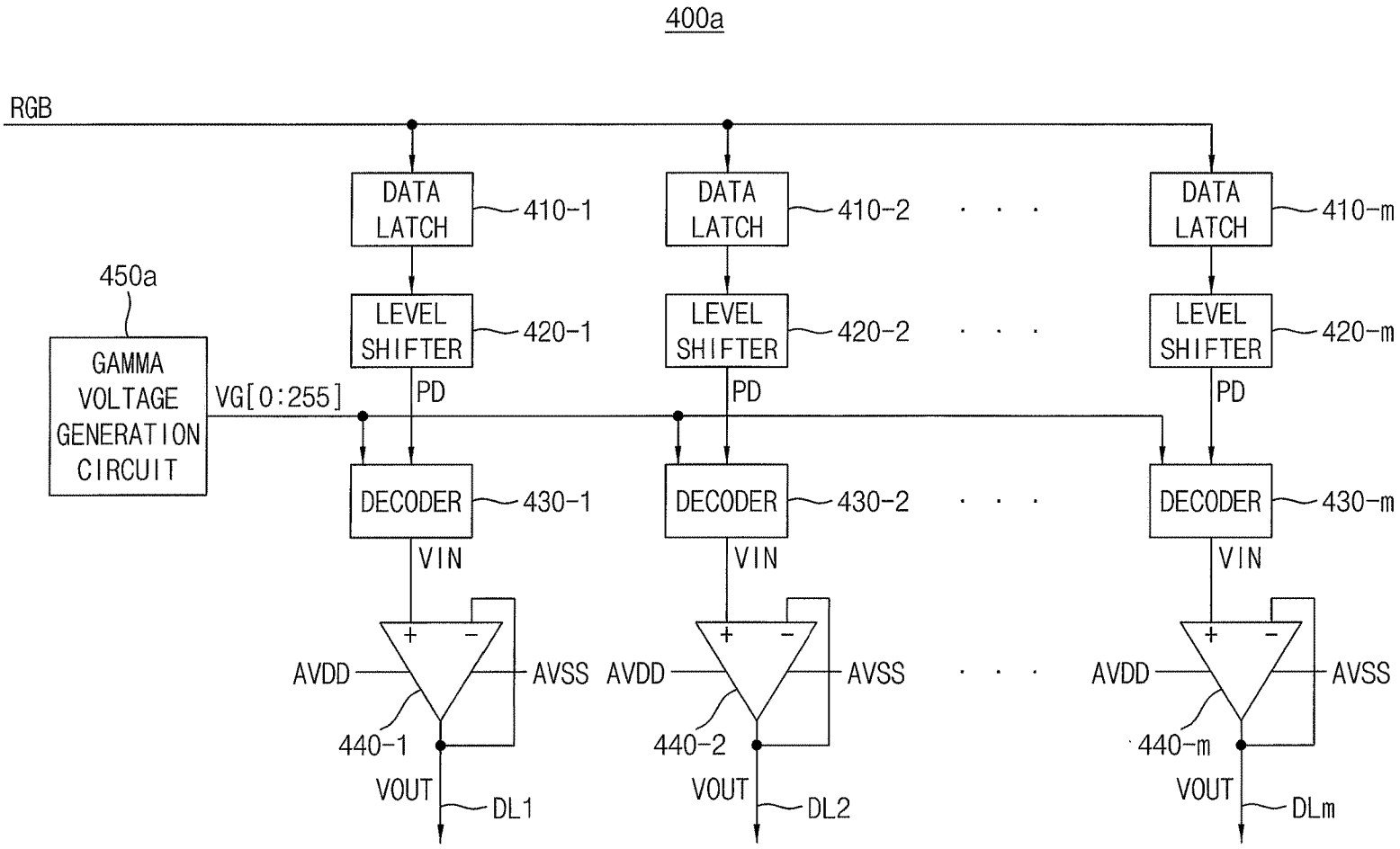
FIG. 5 is a block diagram illustrating a column driver included in the display device of FIG. 1 according to an example embodiment.

FIG. 5 is a block diagram illustrating a column driver included in the display device of FIG. 1 according to an example embodiment. [82] Referring to FIG. 5, a column driver 400*a* may include a plurality of data latches 410-1, 410-2, . . . , 410-*m*, a plurality of level shifters 420-1, 420-2, . . . , 420-*m*, a plurality of decoders 430-1, 430-2, . . . , 430-*m*, a plurality of output buffers 440-1, 440-2, . . . , 440-*m*, and a gamma voltage generation circuit 450*a*.

The plurality of data latches 410-1, 410-2, . . . , 410-*m* may receive the image data RGB including the plurality of pixel data corresponding to one line from the timing controller 200 and latch the plurality of pixel data. The plurality of data latches 410-1, 410-2, . . . , 410-*m* may provide the plurality of pixel data to the plurality of level shifters 420-1, 420-2, . . . , 420-*m* every horizontal period.

The plurality of level shifters 420-1, 420-2, . . . , 420-*m* may adjust voltage levels of the plurality of pixel data.

The gamma voltage generation circuit 450*a* may generate a plurality of gamma voltages VG[0:255].

Although the gamma voltage generation circuit 450*a* is illustrated in FIG. 5 to generate the plurality of gamma voltages VG[0:255] having a gray level of 256, example embodiments are not limited thereto. According to example embodiments, the gamma voltage generation circuit 450*a* may generate any number of gamma voltages.

The plurality of decoders 430-1, 430-2, . . . , 430-*m* may receive the plurality of gamma voltages VG[0:255] from the gamma voltage generation circuit 450*a*. In addition, each of the plurality of decoders 430-1, 430-2, . . . , 430-*m* may receive a corresponding pixel data PD from a corresponding level shifter among the plurality of level shifters 420-1, 420-2, . . . , 420-*m*.

Each of the plurality of decoders 430-1, 430-2, . . . , 430-*m* may select one of the plurality of gamma voltages VG[0:255] based on the corresponding pixel data PD, and output the selected gamma voltage as an input voltage VIN.

Each of the plurality of output buffers 440-1, 440-2, . . . , 440-*m* may be coupled between the drive voltage AVDD provided by the power management integrated circuit 300 as a positive supply voltage and a ground voltage AVSS provided as a negative supply voltage.

In addition, each of the plurality of output buffers 440-1, 440-2, . . . , 440-*m* may generate the output voltage VOUT corresponding to the input voltage VIN using the drive voltage AVDD. Therefore, a maximum voltage level of the output voltage VOUT, which is output from each of the plurality of output buffers 440-1, 440-2, . . . , 440-*m*, may correspond to a voltage level of the drive voltage AVDD provided to each of the plurality of output buffers 440-1, 440-2, . . . , 440-*m*.

The plurality of output buffers 440-1, 440-2, . . . , 440-*m* may provide the plurality of output voltages VOUT to the display panel 100 through the plurality of data lines DL1~DLm.

Figure 6:
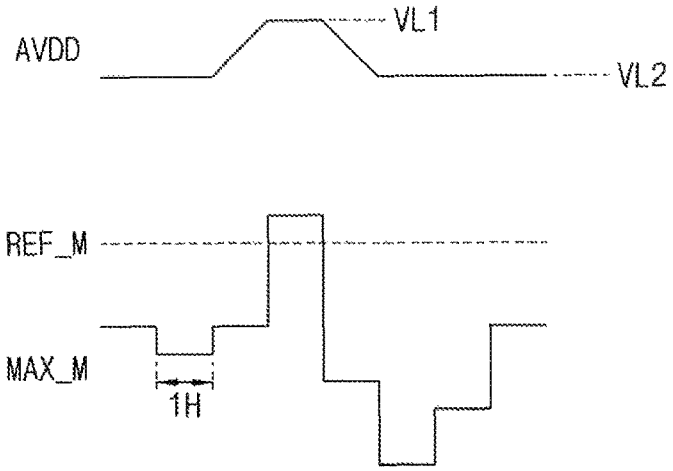
FIGS. 6 and 7 are diagrams for describing operations of the display driving device included in the display device of FIG. 1 according to example embodiments.
Figure 7:
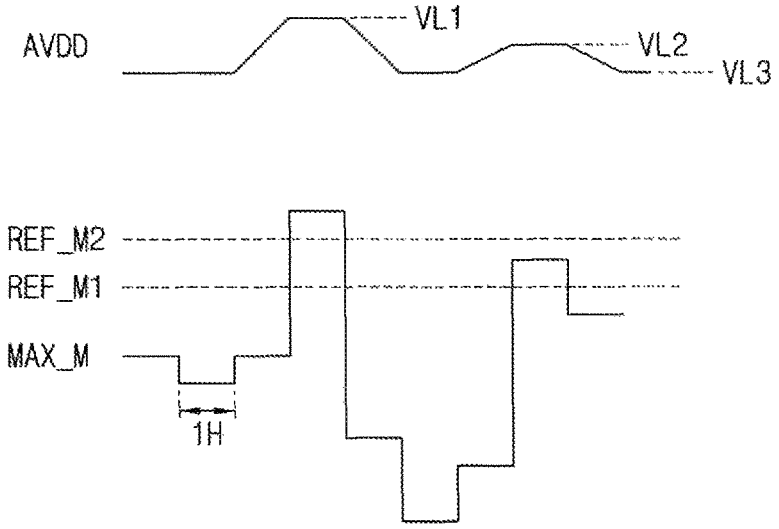

FIGS. 6 and 7 are diagrams for describing an operation of the display driving device included in the display device of FIG. 1 according to example embodiments.

FIG. 6 represents an operation of the display driving device 20 when the display driving device 20 includes the timing controller 200*a* of FIG. 2.

As illustrated in FIG. 6, the maximum magnitude MAX_M of the plurality of pixel data corresponding to one line may vary line by line.

Referring to FIG. 6, the power management integrated circuit 300 may provide the drive voltage AVDD having a second voltage level VL2 to the column driver 400 during a horizontal period 1H in which the maximum magnitude MAX_M is smaller than the reference magnitude REF_M, and provide the drive voltage AVDD having a first voltage level VL1 higher than the second voltage level VL2 to the column driver 400 during a horizontal period 1H in which the maximum magnitude MAX_M is greater than the reference magnitude REF_M.

FIG. 7 represents an operation of the display driving device 20 when the display driving device 20 includes the timing controller 200*b* of FIG. 3.

As illustrated in FIG. 7, the maximum magnitude MAX_M of the plurality of pixel data corresponding to one line may vary line by line.

Referring to FIG. 7, the power management integrated circuit 300 may provide the drive voltage AVDD having a third voltage level VL3 to the column driver 400 during a horizontal period 1H in which the maximum magnitude MAX_M is smaller than the first reference magnitude REF_M1, provide the drive voltage AVDD having a second voltage level VL2 higher than the third voltage level VL3 to the column driver 400 during a horizontal period 1H in which the maximum magnitude MAX_M is greater than the first reference magnitude REF_M1 and smaller than the second reference magnitude REF_M2, and provide the drive voltage AVDD having the first voltage level VL1 higher than the second voltage level VL2 to the column driver 400 during a horizontal period 1H in which the maximum magnitude MAX_M is greater than the second reference magnitude REF_M2.

As illustrated in FIG. 5, each of the plurality of output buffers 440-1, 440-2, . . . , **440-*m* may be coupled between the drive voltage AVDD and the ground voltage AVSS to operate using the drive voltage AVDD. Therefore, power consumption of each of the plurality of output buffers 440-1, 440-2, . . . , 440-*m*** may be proportional to a difference between the drive voltage AVDD and the ground voltage AVSS.

As described above with reference to FIGS. 1 to 7, the display driving device 20 according to example embodiments may increase the voltage level of the drive voltage AVDD when the maximum magnitude of the plurality of pixel data included in the image data RGB is relatively great, and decrease the voltage level of the drive voltage AVDD when the maximum magnitude of the plurality of pixel data included in the image data RGB is relatively small.

Therefore, the display driving device 20 according to example embodiments may effectively decrease power consumption without decreasing performance by increasing the voltage level of the drive voltage AVDD when a voltage level of the output voltage VOUT, which is output from each of the plurality of output buffers 440-1, 440-2, . . . , **440-*m***, is required to be increased and decreasing the voltage level of the drive voltage AVDD when a voltage level of the output voltage VOUT is required to be decreased.

Figure 8:
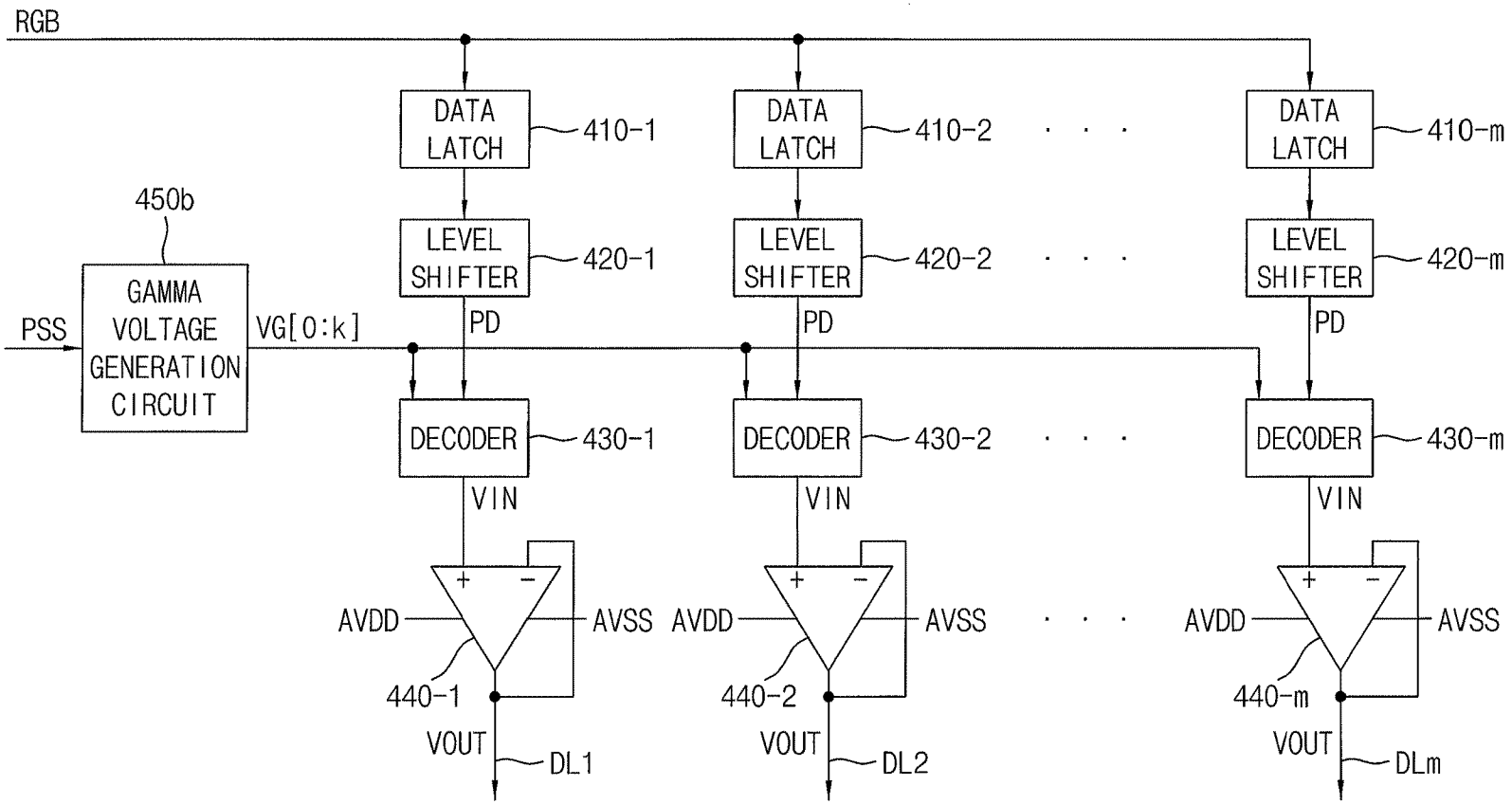
FIG. 8 is a block diagram illustrating a column driver included in the display device of FIG. 1 according to another example embodiment.

FIG. 8 is a block diagram illustrating another example of a column driver included in the display device of FIG. 1.

Referring to FIG. 8, a column driver **400*b* may include a plurality of data latches 410-1, 410-2, . . . , 410-*m*, a plurality of level shifters 420-1, 420-2, . . . , 420-*m*, a plurality of decoders 430-1, 430-2, . . . , 430-*m*, a plurality of output buffers 440-1, 440-2, . . . , 440-*m*, and a gamma voltage generation circuit 450*b***.

The column driver **400*b* of FIG. 8 is the same as the column driver 400*a* of FIG. 5 except for an operation of the gamma voltage generation circuit 450*b***. Therefore, duplicated descriptions will be omitted here.

The gamma voltage generation circuit **450*b*** may generate a plurality of gamma voltages VG[0:255].

In some example embodiments, the gamma voltage generation circuit **450*b* may receive the power saving signal PSS from the timing controller 200**.

In this case, the gamma voltage generation circuit **450*b*** may selectively stop generating at least one gamma voltage, which has a relatively high voltage level, among the plurality of gamma voltages VG[0:255] based on the power saving signal PSS.

For example, when the display driving device 20 includes the timing controller **200*a* of FIG. 2, the gamma voltage generation circuit 450*b*** may generate all of the plurality of gamma voltages VG[0:255] while the power saving signal PSS is deactivated, and stop generating the gamma voltages VG[k+1:255] having a relatively high voltage level and generate only the gamma voltages VG[0:k] having a relatively low voltage level while the power saving signal PSS is activated. Here, k represents a positive integer smaller than 255.

Figure 9:
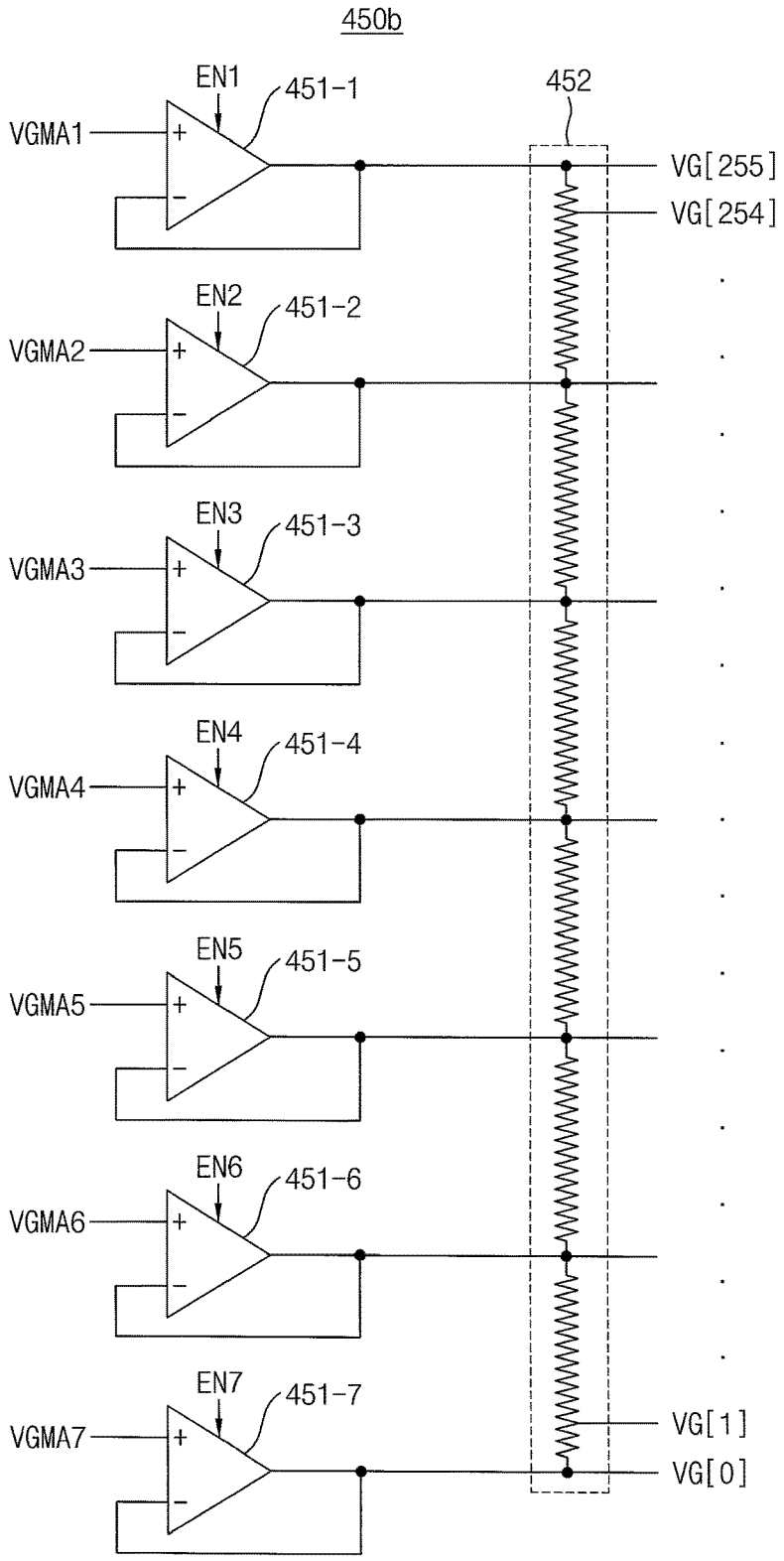
FIG. 9 is a circuit diagram illustrating a gamma voltage generation circuit included in the column driver of FIG. 8 according to an example embodiment.

FIG. 9 is a circuit diagram illustrating a gamma voltage generation circuit included in the column driver of FIG. 8 according to an example embodiment.

Referring to FIG. 9, the gamma voltage generation circuit **450*b* may include a plurality of amplifiers 451-1~451-7 and a resistor circuit 452**.

As illustrated in FIG. 9, the plurality of amplifiers 451-1~451-7 may amplify a plurality of reference gamma voltages VGMA1~VGMA7, respectively.

In some example embodiments, the plurality of reference gamma voltages VGMA1~VGMA7 may have different voltage levels which are consecutively lowered. For example, a voltage level of the first reference gamma voltage VGMA1 is the greatest among the plurality of reference gamma voltages VGMA1~VGMA7, and a voltage level of the seventh reference gamma voltage VGMA7 is the smallest among the plurality of reference gamma voltages VGMA1~VGMA7.

Although the gamma voltage generation circuit **450*b* is illustrated in FIG. 9 to include seven amplifiers, example embodiments are not limited thereto. According to example embodiments, the gamma voltage generation circuit 450*b*** may include any number of amplifiers.

The resistor circuit 452 may connect output electrodes of the plurality of amplifiers 451-1~451-7 to each other with a resistor. Therefore, as illustrated in FIG. 9, the resistor circuit 452 may output the plurality of gamma voltages VG[0:255] through different nodes on the resistor.

The gamma voltage generation circuit **450*b* may internally generate a plurality of enable signals EN1~EN7 based on the power saving signal PSS received from the timing controller 200. The plurality of enable signals EN1~EN7 may be provided to the plurality of amplifiers 451-1~451-7**, respectively.

Each of the plurality of amplifiers 451-1~451-7 may be turned on to amplify a corresponding reference gamma voltage VGMA1~VGMA7 when a corresponding enable signal EN1~EN7 is activated.

On the other hand, each of the plurality of amplifiers 451-1~451-7 may be turned off when a corresponding enable signal EN1~EN7 is deactivated.

In some example embodiments, when the power saving signal PSS is deactivated, the gamma voltage generation circuit **450*b* may activate all of the plurality of enable signals EN1~EN7 to turn on all of the plurality of amplifiers 451-1~451-7**.

On the other hand, when the power saving signal PSS is activated, the gamma voltage generation circuit **450*b* may deactivate at least one enable signal EN1~ENq, which is provided to the amplifier receiving the reference gamma voltage having a relatively high voltage level, among the plurality of enable signals EN1~EN7, and activate only the rest of the enable signals EN(q+1)~EN7. For example, when the power saving signal PSS is activated, the gamma voltage generation circuit 450*b* may deactivate the first enable signal EN1 and the second enable signal EN2 and activate only the third through seventh enable signals EN3~EN7**.

In this case, the gamma voltage generation circuit **450*b*** may stop generating the gamma voltages VG[k+1:255] having a relatively high voltage level and generate only the gamma voltages VG[0:k] having a relatively low voltage level.

Since at least one of the plurality of amplifiers 451-1~451-7 is turned off when the power saving signal PSS is activated, power consumption of the gamma voltage generation circuit **450*b*** may be decreased.

As described above, the power saving signal PSS may be activated when the maximum magnitude MAX_M of the plurality of pixel data included in the image data RGB is smaller than the reference magnitude REF_M. Therefore, while the power saving signal PSS is activated, each of the plurality of decoders 430-1, 430-2, . . . , **430-*m*** may not select a gamma voltage having a relatively high voltage level among the plurality of gamma voltages VG[0:255] as the input voltage VIN.

Therefore, although the gamma voltage generation circuit **450*b* stops generating at least one of the plurality of gamma voltages VG[0:255] having a relatively high voltage level while the power saving signal PSS is activated, the display driving device 20** may operate correctly with a decreased power consumption.

Figure 10:
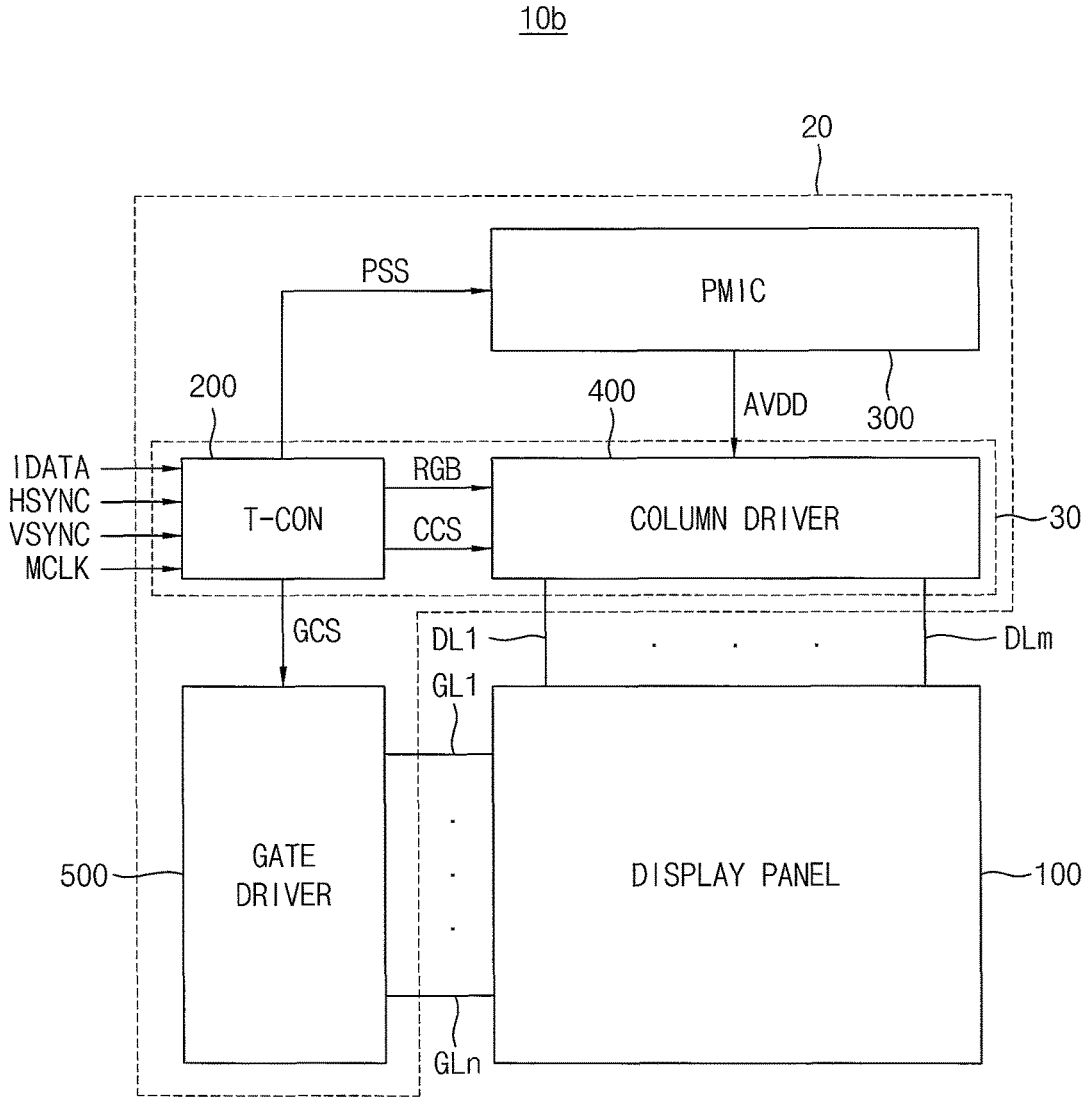
FIG. 10 is a block diagram illustrating a display device according to example embodiments.

FIG. 10 is a block diagram illustrating a display device according to example embodiments.

The display device **10*b* of FIG. 10 is the same as the display device 10*a* of FIG. 1 except that the timing controller 200 and the column driver 400 included in the display device 10*b* of FIG. 10 are included in the same integrated circuit 30 while the timing controller 200 and the column driver 400 included in the display device 10*a* of FIG. 1** are included in different integrated circuits from each other.

As illustrated in FIGS. 1 and 10, according to example embodiments, the timing controller 200 and the column driver 400 may be implemented as the same integrated circuit 30 or be implemented as different integrated circuits from each other.

Figure 11:
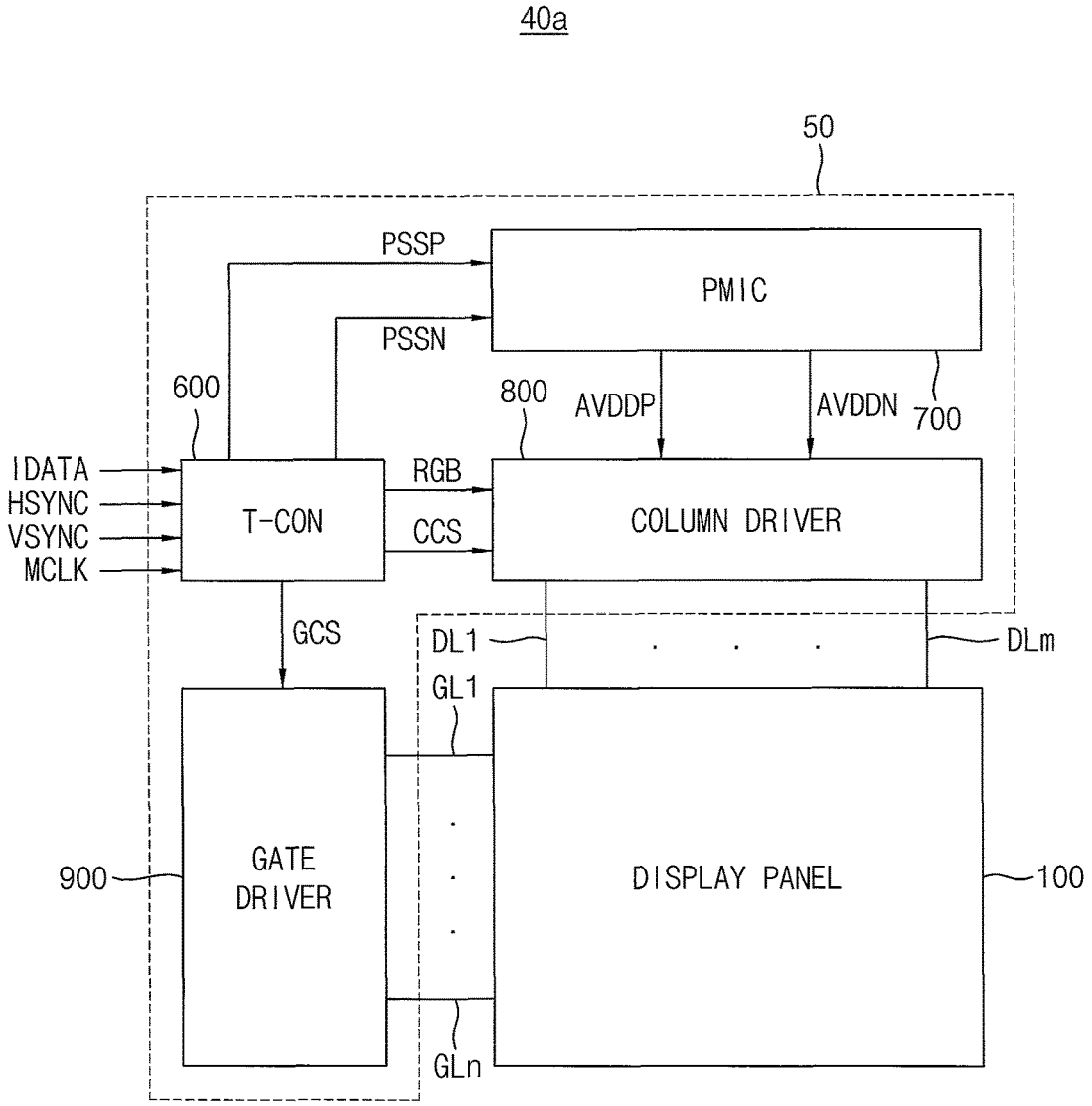
FIG. 11 is a block diagram illustrating a display device according to example embodiments.

FIG. 11 is a block diagram illustrating a display device according to example embodiments.

Referring to FIG. 11, a display device **40*a* includes a display panel 100 and a display driving device 50**.

The display panel 100 may include red pixels, green pixels, and blue pixels coupled to a plurality of gate lines GL1~GLn and a plurality of data lines DL1~DLm. Here, n and m represent positive integers.

The display driving device 50 may include a timing controller T_CON 600, a power management integrated circuit PMIC 700, a column driver 800, and a gate driver 900.

In some example embodiments, the timing controller 600 and the column driver 800 may be included in different integrated circuits from each other.

The timing controller 600 may receive input data IDATA, a horizontal synchronization signal HSYNC, a vertical synchronization signal VSYNC, and a main clock signal MCLK from a host. The timing controller 600 may generate a gate control signal GCS and a column control signal CCS based on the horizontal synchronization signal HSYNC, the vertical synchronization signal VSYNC, and the main clock signal MCLK.

In addition, the timing controller 600 may divide the input data IDATA in a unit of a frame based on the vertical synchronization signal VSYNC, and divide the input data IDATA in a unit of a line based on the horizontal synchronization signal HSYNC to generate image data RGB. Therefore, the image data RGB may include a plurality of pixel data corresponding to a plurality of pixels disposed in a same line.

The timing controller 600 may generate a positive power saving signal PSSP based on magnitudes of positive polarity pixel data among the plurality of pixel data included in the image data RGB and a positive reference magnitude, and generate a negative power saving signal PSSN based on magnitudes of negative polarity pixel data among the plurality of pixel data included in the image data RGB and a negative reference magnitude. The timing controller 600 may provide the positive power saving signal PSSP and the negative power saving signal PSSN to the power management integrated circuit 700.

The power management integrated circuit 700 may generate a positive drive voltage AVDDP having a voltage level varied based on the positive power saving signal PSSP, and generate a negative drive voltage AVDDN having a voltage level varied based on the negative power saving signal PSSN. The power management integrated circuit 700 may provide the positive drive voltage AVDDP and the negative drive voltage AVDDN to the column driver 800.

In some example embodiments, the timing controller 600 may deactivate the positive power saving signal PSSP when a maximum magnitude of the positive polarity pixel data included in the image data RGB is equal to or greater than the positive reference magnitude, and activate the positive power saving signal PSSP when the maximum magnitude of the positive polarity pixel data included in the image data RGB is smaller than the positive reference magnitude. Similarly, the timing controller 600 may deactivate the negative power saving signal PSSN when a maximum magnitude of the negative polarity pixel data included in the image data RGB is equal to or greater than the negative reference magnitude, and activate the negative power saving signal PSSN when the maximum magnitude of the negative polarity pixel data included in the image data RGB is smaller than the negative reference magnitude.

In this case, the power management integrated circuit 700 may generate the positive drive voltage AVDDP having a first voltage level when the positive power saving signal PSSP is deactivated, and generate the positive drive voltage AVDDP having a second voltage level lower than the first voltage level when the positive power saving signal PSSP is activated. Similarly, the power management integrated circuit 700 may generate the negative drive voltage AVDDN having a third voltage level when the negative power saving signal PSSN is deactivated, and generate the negative drive voltage AVDDN having a fourth voltage level lower than the third voltage level when the negative power saving signal PSSN is activated.

In other example embodiments, the timing controller 600 may compare the maximum magnitude of the positive polarity pixel data included in the image data RGB with each of first through t-th positive reference magnitudes to generate the positive power saving signal PSSP having one of first through (t+1)-th values. Similarly, the timing controller 600 may compare the maximum magnitude of the negative polarity pixel data included in the image data RGB with each of first through t-th negative reference magnitudes to generate the negative power saving signal PSSN having one of the first through (t+1)-th values.

In this case, the power management integrated circuit 700 may generate the positive drive voltage AVDDP having a voltage level proportional to the value of the positive power saving signal PSSP, and generate the negative drive voltage AVDDN having a voltage level proportional to the value of the negative power saving signal PSSN.

The timing controller 600 may provide the gate control signal GCS to the gate driver 900, and provide the column control signal CCS and the image data RGB to the column driver 800.

The gate driver 900 may be coupled to the display panel 100 through the plurality of gate lines GL1~GLn. The gate driver 900 may consecutively select the plurality of gate lines GL1~GLn based on the gate control signal GCS.

The column driver 800 may be coupled to the display panel 100 through the plurality of data lines DL1~DLm. The column driver 800 may generate a plurality of positive output voltages corresponding to the positive polarity pixel data included in the image data RGB by processing the positive polarity pixel data included in the image data RGB using the positive drive voltage AVDDP based on the column control signal CCS, and generate a plurality of negative output voltages corresponding to the negative polarity pixel data included in the image data RGB by processing the negative polarity pixel data included in the image data RGB using the negative drive voltage AVDDN based on the column control signal CCS. The column driver 800 may provide the plurality of positive output voltages and the plurality of negative output voltages to the display panel 100 through the plurality of data lines DL1~DLm.

In some example embodiments, the display panel 100 may be driven by the display driving device 20 in an inversion scheme. For example, the display panel 100 may correspond to a liquid crystal display (LCD) panel. In this case, the display driving device 50 may alternately provide the positive output voltage and the negative output voltage to each of the pixels included in the display panel 100.

FIGS. 12A and 12B are diagrams for describing an inversion driving scheme of the display device of FIG. 11 according to an example embodiment.

A column inversion driving scheme of the display panel 100 is illustrated in FIGS. 12A and 12B as an example.

As illustrated in FIG. 12A, during a P-th frame, the display driving device 50 may provide the positive output voltage to each of the pixels disposed in even columns and provide the negative output voltage to each of the pixels disposed in odd columns.

On the other hand, during a (P+1)-th frame, the display driving device 50 may provide the negative output voltage to each of the pixels disposed in even columns and provide the positive output voltage to each of the pixels disposed in odd columns.

Although the display panel 100 is illustrated in FIGS. 12A and 12B to be driven according to a column inversion scheme, example embodiments are not limited thereto. According to example embodiments, the display panel 100 may be driven according to various inversion schemes.

As described above, when the maximum magnitude of the positive polarity pixel data included in the image data RGB is relatively great, the column driver 800 may generate the positive output voltage having a relatively high voltage level. On the other hand, when the maximum magnitude of the positive polarity pixel data included in the image data RGB is relatively small, the column driver 800 may generate the positive output voltage having a relatively low voltage level.

Similarly, when the maximum magnitude of the negative polarity pixel data included in the image data RGB is relatively great, the column driver 800 may generate the negative output voltage having a relatively high voltage level. On the other hand, when the maximum magnitude of the negative polarity pixel data included in the image data RGB is relatively small, the column driver 800 may generate the negative output voltage having a relatively low voltage level.

Therefore, when the maximum magnitude of the positive polarity pixel data included in the image data RGB is relatively great, the power management integrated circuit 700 included in the display driving device 50 according to example embodiments may provide the positive drive voltage AVDDP having a relatively high voltage level to the column driver 800 during a horizontal period in which the plurality of positive output voltages corresponding to the positive polarity pixel data are provided to the display panel 100. Similarly, when the maximum magnitude of the negative polarity pixel data included in the image data RGB is relatively great, the power management integrated circuit 700 included in the display driving device 50 according to example embodiments may provide the negative drive voltage AVDDN having a relatively high voltage level to the column driver 800 during a horizontal period in which the plurality of negative output voltages corresponding to the negative polarity pixel data are provided to the display panel 100.

On the other hand, when the maximum magnitude of the positive polarity pixel data included in the image data RGB is relatively small, the power management integrated circuit 700 included in the display driving device 50 according to example embodiments may decrease a voltage level of the positive drive voltage AVDDP to provide the positive drive voltage AVDDP having a relatively low voltage level to the column driver 800 during a horizontal period in which the plurality of positive output voltages corresponding to the positive polarity pixel data are provided to the display panel 100. Similarly, when the maximum magnitude of the negative polarity pixel data included in the image data RGB is relatively small, the power management integrated circuit 700 included in the display driving device 50 according to example embodiments may decrease a voltage level of the negative drive voltage AVDDN to provide the negative drive voltage AVDDN having a relatively low voltage level to the column driver 800 during a horizontal period in which the plurality of negative output voltages corresponding to the negative polarity pixel data are provided to the display panel 100.

Since power consumption of the display driving device 50 decreases as the voltage level of the positive drive voltage AVDDP and the voltage level of the negative drive voltage AVDDN decrease, the display driving device 50 according to example embodiments may effectively decrease power consumption without a separate device for decreasing power consumption.

Figure 13:
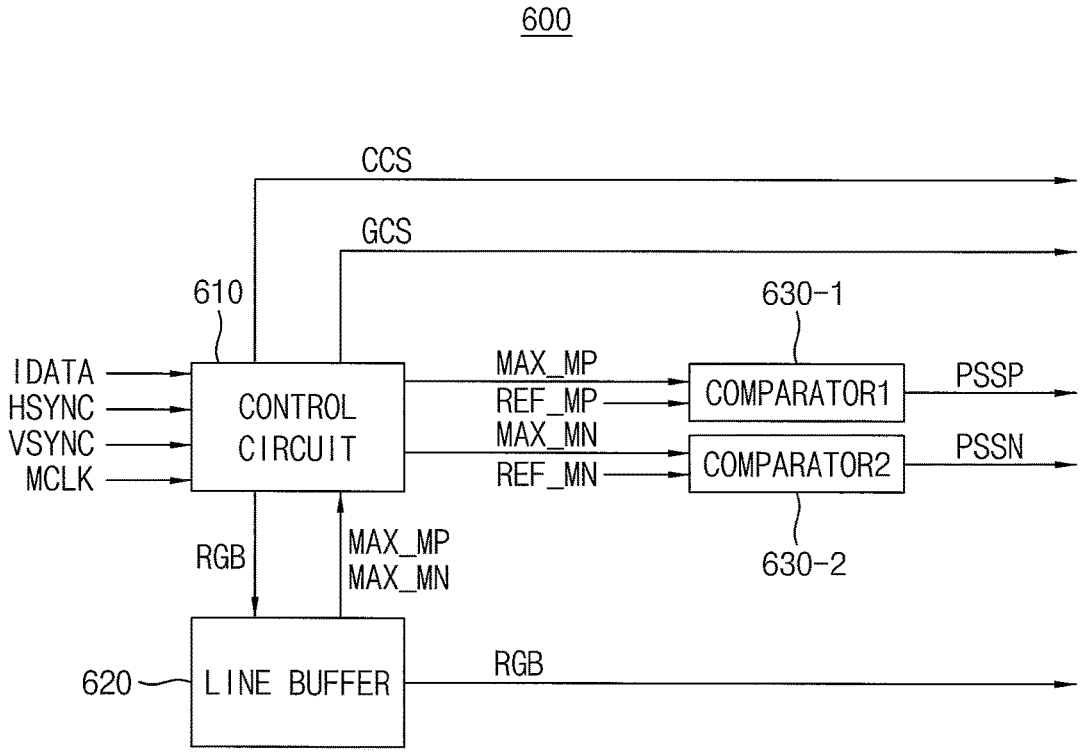
FIG. 13 is a block diagram illustrating a timing controller included in the display device of FIG. 11 according to an example embodiment.

FIG. 13 is a block diagram illustrating a timing controller included in the display device of FIG. 11 according to an example embodiment.

Referring to FIG. 13, a timing controller 600 may include a control circuit 610, a line buffer 620, a first comparator 630-1, and a second comparator 630-2.

The control circuit 610 may receive the input data IDATA, the horizontal synchronization signal HSYNC, the vertical synchronization signal VSYNC, and the main clock signal MCLK from the host. The control circuit 610 may generate the gate control signal GCS and the column control signal CCS based on the horizontal synchronization signal HSYNC, the vertical synchronization signal VSYNC, and the main clock signal MCLK. In addition, the control circuit 610 may divide the input data IDATA in a unit of a frame based on the vertical synchronization signal VSYNC, and divide the input data IDATA in a unit of a line based on the horizontal synchronization signal HSYNC to generate the image data RGB including the plurality of pixel data corresponding to one line. The control circuit 610 may store the image data RGB including the plurality of pixel data corresponding to one line in the line buffer 620.

The image data RGB stored in the line buffer 620 may be provided to the column driver 800.

The control circuit 610 may provide a positive maximum magnitude MAX_MP of positive polarity pixel data among the plurality of pixel data stored in the line buffer 620 to the first comparator 630-1, and provide a negative maximum magnitude MAX_MN of negative polarity pixel data among the plurality of pixel data stored in the line buffer 620 to the second comparator 630-2.

The first comparator 630-1 may compare the positive maximum magnitude MAX_MP with a positive reference magnitude REF_MP to generate the positive power saving signal PSSP.

The second comparator 630-2 may compare the negative maximum magnitude MAX_MN with a negative reference magnitude REF_MN to generate the negative power saving signal PSSN.

In some example embodiments, the first comparator 630-1 may deactivate the positive power saving signal PSSP when the positive maximum magnitude MAX_MP is equal to or greater than the positive reference magnitude REF_MP, and activate the positive power saving signal PSSP when the positive maximum magnitude MAX_MP is smaller than the positive reference magnitude REF_MP. Similarly, the second comparator 630-2 may deactivate the negative power saving signal PSSN when the negative maximum magnitude MAX_MN is equal to or greater than the negative reference magnitude REF_MN, and activate the negative power saving signal PSSN when the negative maximum magnitude MAX_MN is smaller than the negative reference magnitude REF_MN.

In this case, the power management integrated circuit 700 may generate the positive drive voltage AVDDP having the first voltage level when the positive power saving signal PSSP is deactivated, and generate the positive drive voltage AVDDP having the second voltage level lower than the first voltage level when the positive power saving signal PSSP is activated. Similarly, the power management integrated circuit 700 may generate the negative drive voltage AVDDN having the third voltage level when the negative power saving signal PSSN is deactivated, and generate the negative drive voltage AVDDN having the fourth voltage level lower than the third voltage level when the negative power saving signal PSSN is activated.

In some example embodiments, the positive reference magnitude REF_MP and the negative reference magnitude REF_MN may be stored in the timing controller 600. In other example embodiments, the positive reference magnitude REF_MP and the negative reference magnitude REF_MN may be provided by the host.

In some example embodiments, similar to the timing controller 200*b* of FIG. 3, the first comparator 630-1 may compare the positive maximum magnitude MAX_MP with each of the first through t-th positive reference magnitudes to generate the positive power saving signal PSSP having one of the first through (t+1)-th values, and the second comparator 630-2 may compare the negative maximum magnitude MAX_MN with each of the first through t-th negative reference magnitudes to generate the negative power saving signal PSSN having one of the first through (t+1)-th values. In this case, the power management integrated circuit 700 may generate the positive drive voltage AVDDP having a voltage level proportional to the value of the positive power saving signal PSSP, and generate the negative drive voltage AVDDN having a voltage level proportional to the value of the negative power saving signal PSSN.

In some example embodiments, similar to the timing controller 200*c* of FIG. 4, the timing controller 600 may activate the positive power saving signal PSSP only when the positive maximum magnitude MAX_MP of the positive polarity pixel data included in each of a plurality of consecutive lines is smaller than the positive reference magnitude REF_MP, and activate the negative power saving signal PSSN only when the negative maximum magnitude MAX_MN of the negative polarity pixel data included in each of a plurality of consecutive lines is smaller than the negative reference magnitude REF_MN.

Figure 14:
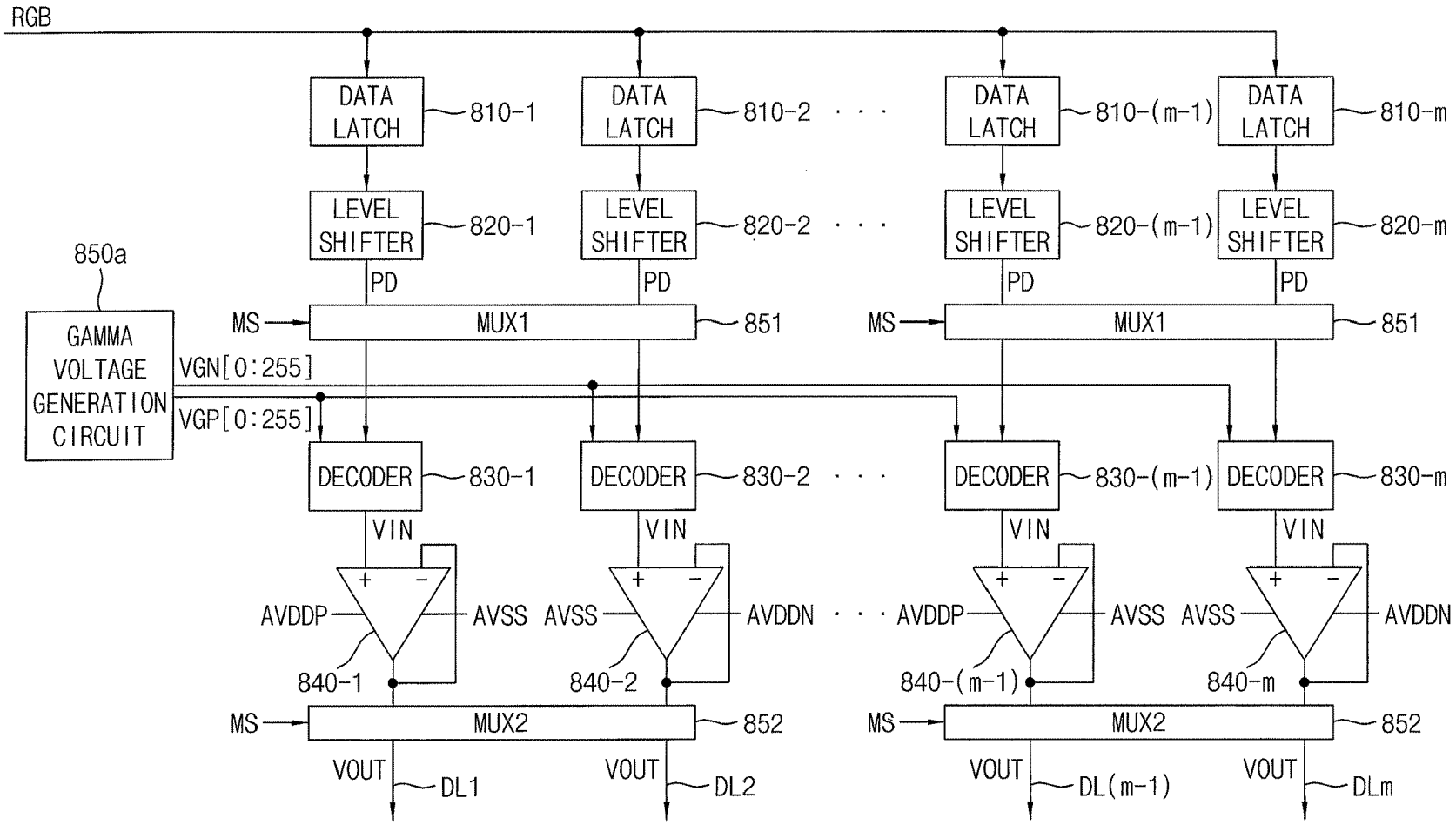
FIG. 14 is a block diagram illustrating a column driver included in the display device of FIG. 11 according to an example embodiment.

FIG. 14 is a block diagram illustrating a column driver included in the display device of FIG. 11 according to an example embodiment.

Referring to FIG. 14, a column driver 800*a* may include a plurality of data latches 810-1, 810-2, . . . , 810-($m$−1), 810-$m$, a plurality of level shifters 820-1, 820-2, . . . , 820-($m$−1), 820-$m$, a plurality of decoders 830-1, 830-2, . . . , 830-($m$−1), 830-$m$, a plurality of output buffers 840-1, 840-2, . . . , 840-($m$−1), 840-$m$, a gamma voltage generation circuit 850*a*, a first multiplexer MUX1 851, and a second multiplexer MUX2 852.

The plurality of data latches 810-1, 810-2, . . . , 810-($m$−1), 810-$m$ may receive the image data RGB including the plurality of pixel data corresponding to one line from the timing controller 600 and latch the plurality of pixel data. The plurality of data latches 810-1, 810-2, . . . , 810-($m$−1), 810-$m$ may provide the plurality of pixel data to the plurality of level shifters 820-1, 820-2, . . . , 820-($m$−1), 820-$m$ every horizontal periods.

The plurality of level shifters 820-1, 820-2, . . . , 820-($m$−1), 820-$m$ may adjust voltage levels of the plurality of pixel data.

The gamma voltage generation circuit 850*a* may generate a plurality of positive gamma voltages VGP[0:255] and a plurality of negative gamma voltages VGN[0:255].

The plurality of decoders 830-1, 830-2, . . . , 830-($m$−1), 830-$m$ may receive a corresponding pixel data PD from a corresponding level shifter among the plurality of level shifters 820-1, 820-2, . . . , 820-($m$−1), 820-$m$. In addition, positive decoders, which are disposed in even columns, among the plurality of decoders 830-1, 830-2, . . . , 830-($m$−1), 830-$m$ may receive the plurality of positive gamma voltages VGP[0:255] from the gamma voltage generation circuit 850*a*, and negative decoders, which are disposed in odd columns, among the plurality of decoders 830-1, 830-2, . . . , 830-($m$−1), 830-$m$ may receive the plurality of negative gamma voltages VGN[0:255] from the gamma voltage generation circuit 850*a*.

Each of the positive decoders may select one of the plurality of positive gamma voltages VGP[0:255] based on the corresponding pixel data PD, and output the selected positive gamma voltage as an input voltage VIN. Each of the negative decoders may select one of the plurality of negative gamma voltages VGN[0:255] based on the corresponding pixel data PD, and output the selected negative gamma voltage as the input voltage VIN.

The plurality of output buffers 840-1, 840-2, . . . , 840-($m$−1), 840-$m$ may include positive output buffers disposed in even columns and negative output buffers disposed in odd columns.

Each of the positive output buffers may be coupled between the positive drive voltage AVDDP provided by the power management integrated circuit 700 and the ground voltage AVSS. Each of the negative output buffers may be coupled between the negative drive voltage AVDDN provided by the power management integrated circuit 700 and the ground voltage AVSS.

Each of the positive output buffers may generate the output voltage VOUT corresponding to the input voltage VIN using the positive drive voltage AVDDP, and each of the negative output buffers may generate the output voltage VOUT corresponding to the input voltage VIN using the negative drive voltage AVDDN. Therefore, a maximum voltage level of the output voltage VOUT, which is output from each of the positive output buffers, may correspond to a voltage level of the positive drive voltage AVDDP provided to each of the positive output buffers, and a maximum voltage level of the output voltage VOUT, which is output from each of the negative output buffers, may correspond to a voltage level of the negative drive voltage AVDDN provided to each of the negative output buffers.

As illustrated in FIG. 14, based on a path control signal MS, the first multiplexer 851 may provide the pixel data PD received from the plurality of level shifters 820-1, 820-2, . . . , 820-(*m*−1), 820-*m* to the decoders disposed in the same columns or crossly provide the pixel data PD received from the plurality of level shifters 820-1, 820-2, . . . , 820-(*m*−1), 820-*m* to decoders disposed in adjacent columns.

Similarly, as illustrated in FIG. 14, based on the path control signal MS, the second multiplexer 852 may output the output voltage VOUT received from the plurality of output buffers 840-1, 840-2, . . . , 840-(*m*−1), 840-*m* through the data lines disposed in the same columns or crossly output the output voltage VOUT received from the plurality of output buffers 840-1, 840-2, . . . , 840-(*m*−1), 840-*m* through the data lines disposed in adjacent columns.

The path control signal MS may be inverted for every frame. Therefore, the column driver 800*a* of FIG. 14 may drive the display panel 10 according to a column inversion scheme.

In some example embodiments, the path control signal MS may be provided by the timing controller 600.

As illustrated in FIG. 14, each of the positive output buffers may be coupled between the positive drive voltage AVDDP and the ground voltage AVSS to operate using the positive drive voltage AVDDP, and each of the negative output buffers may be coupled between the negative drive voltage AVDDN and the ground voltage AVSS to operate using the negative drive voltage AVDDN. Therefore, power consumption of the plurality of output buffers 840-1, 840-2, . . . , 840-(*m*−1), 840-*m* may be proportional to a difference between the positive drive voltage AVDDP and the negative drive voltage AVDDN.

As described above with reference to FIGS. 11 to 14, the display driving device 50 according to example embodiments may increase the voltage level of the positive drive voltage AVDDP when the maximum magnitude of the positive polarity pixel data included in the image data RGB is relatively great, and decrease the voltage level of the positive drive voltage AVDDP when the maximum magnitude of the positive polarity pixel data included in the image data RGB is relatively small. Similarly, the display driving device 50 according to example embodiments may increase the voltage level of the negative drive voltage AVDDN when the maximum magnitude of the negative polarity pixel data included in the image data RGB is relatively great, and decrease the voltage level of the negative drive voltage AVDDN when the maximum magnitude of the negative polarity pixel data included in the image data RGB is relatively small. Therefore, the display driving device 50 according to example embodiments may effectively decrease power consumption without decreasing performance.

Figure 15:
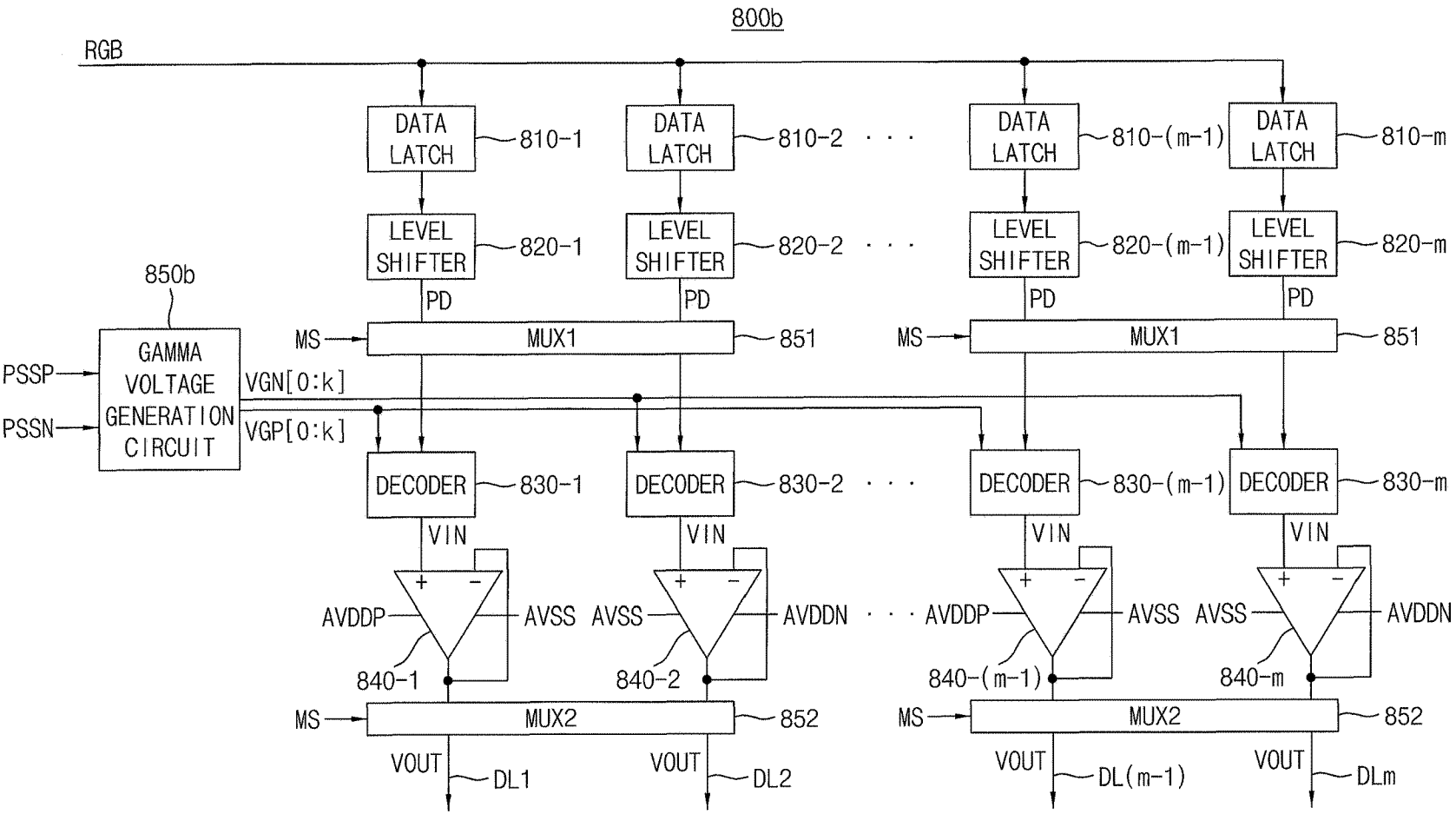
FIG. 15 is a block diagram illustrating a column driver included in the display device of FIG. 11 according to another example embodiment.

FIG. 15 is a block diagram illustrating a column driver included in the display device of FIG. 11 according to another example embodiment.

Referring to FIG. 15, a column driver 800*b* may include a plurality of data latches 810-1, 810-2, . . . , 810-(*m*−1), 810-*m*, a plurality of level shifters 820-1, 820-2, . . . , 820-(*m*−1), 820-*m*, a plurality of decoders 830-1, 830-2, . . . , 830-(*m*−1), 830-*m*, a plurality of output buffers 840-1, 840-2, . . . , 840-(*m*−1), 840-*m*, a gamma voltage generation circuit 850*b*, a first multiplexer MUX1 851, and a second multiplexer MUX2 852.

The column driver 800*b* of FIG. 15 is the same as the column driver 800*a* of FIG. 14 except for an operation of the gamma voltage generation circuit 850*b*. Therefore, duplicated descriptions will be omitted here.

The gamma voltage generation circuit 850*b* may generate a plurality of positive gamma voltages VGP[0:255] and a plurality of negative gamma voltages VGN[0:255].

In some example embodiments, the gamma voltage generation circuit 850*b* may receive the positive power saving signal PSSP and the negative power saving signal PSSN from the timing controller 600.

In this case, the gamma voltage generation circuit 850*b* may selectively stop generating at least one positive gamma voltage, which has a relatively high voltage level, among the plurality of positive gamma voltages VGP[0:255] based on the positive power saving signal PSSP, and selectively stop generating at least one negative gamma voltage, which has a relatively high voltage level, among the plurality of negative gamma voltages VGN[0:255] based on the negative power saving signal PSSN.

For example, when the display driving device 50 includes the timing controller 600 of FIG. 13, the gamma voltage generation circuit 850*b* may generate all of the plurality of positive gamma voltages VGP[0:255] while the positive power saving signal PSSP is deactivated, and stop generating the positive gamma voltages VGP[k+1:255] having a relatively high voltage level and generate only the positive gamma voltages VGP[0:k] having a relatively low voltage level while the positive power saving signal PSSP is activated. Similarly, when the display driving device 50 includes the timing controller 600 of FIG. 13, the gamma voltage generation circuit 850*b* may generate all of the plurality of negative gamma voltages VGN[0:255] while the negative power saving signal PSSN is deactivated, and stop generating the negative gamma voltages VGN[k+1:255] having a relatively high voltage level and generate only the negative gamma voltages VGN[0:k] having a relatively low voltage level while the negative power saving signal PSSN is activated. Here, k represents a positive integer smaller than 255.

As described above, while the positive power saving signal PSSP is activated, each of the positive decoders may not select a positive gamma voltage having a relatively high voltage level among the plurality of positive gamma voltages VGP[0:255] as the input voltage VIN. Similarly, while the negative power saving signal PSSN is activated, each of the negative decoders may not select a negative gamma voltage having a relatively high voltage level among the plurality of negative gamma voltages VGN[0:255] as the input voltage VIN.

Therefore, although the gamma voltage generation circuit 850*b* stops generating at least one of the plurality of positive gamma voltages VGP[0:255] having a relatively high voltage level while the positive power saving signal PSSP is activated and stops generating at least one of the plurality of negative gamma voltages VGN[0:255] having a relatively high voltage level while the negative power saving signal PSSN is activated, the display driving device 50 may operate correctly with a decreased power consumption.

Figure 16:
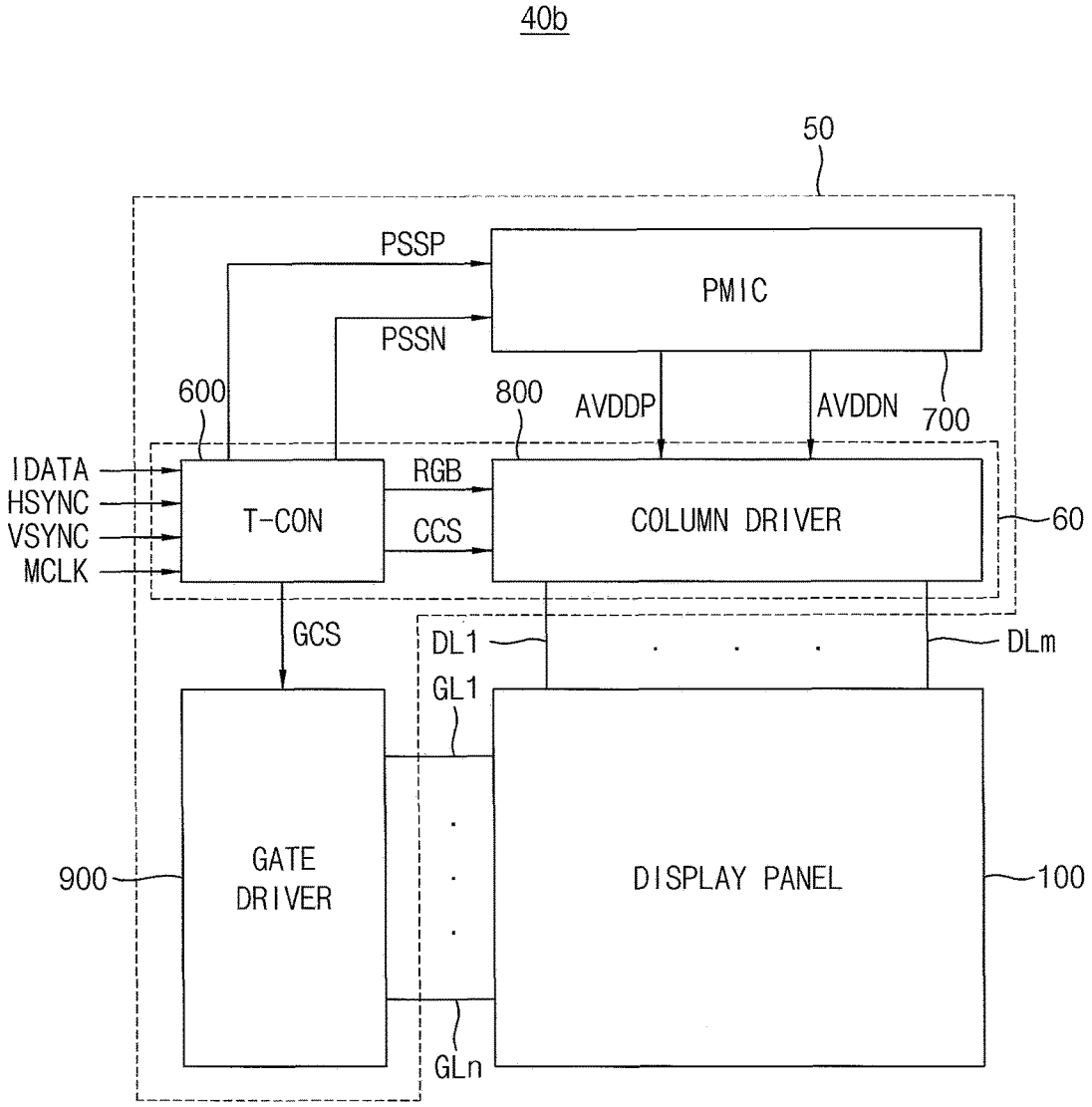
FIG. 16 is a block diagram illustrating a display device according to example embodiments.

FIG. 16 is a block diagram illustrating a display device according to example embodiments.

The display device 40*b* of FIG. 16 is the same as the display device 40*a* of FIG. 11 except that the timing controller 600 and the column driver 800 included in the display device 40*b* of FIG. 16 are included in the same integrated circuit 60 while the timing controller 600 and the column driver 800 included in the display device 40*a* of FIG. 11 are included in different integrated circuits from each other.

As illustrated in FIGS. 11 and 16, according to example embodiments, the timing controller 600 and the column driver 800 may be implemented as the same integrated circuit 60 or be implemented as different integrated circuits from each other.

The foregoing is illustrative of the present inventive concept and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display driving device comprising:

a timing controller comprising:

a line buffer;

a control circuit configured to divide input data in a unit of a line to generate image data and store a plurality of pixel data corresponding to one line of the image data-in the line buffer; and a comparator configured to compare a maximum magnitude of the plurality of pixel data stored in the line buffer with a reference magnitude and generate a power saving signal based on the comparison;

a power management integrated circuit configured to generate a drive voltage having a voltage level that is varied based on the power saving signal; and a column driver configured to receive the image data and the drive voltage, and to generate a plurality of output voltages corresponding to the plurality of pixel data included in the image data based on the drive voltage.

2. The display driving device of claim 1, wherein the timing controller is further configured to:

deactivate the power saving signal when the maximum magnitude of the plurality of pixel data is equal to or greater than the reference magnitude, and activate the power saving signal when the maximum magnitude of the plurality of pixel data is less than the reference magnitude.

3. The display driving device of claim 2, wherein the power management integrated circuit is further configured to generate the drive voltage having a first voltage level when the power saving signal is deactivated, and generate the drive voltage having a second voltage level lower than the first voltage level when the power saving signal is activated.

4. The display driving device of claim 1, wherein the timing controller is further configured to compare in a comparison a maximum magnitude of the plurality of pixel data with each of first through t-th reference magnitudes and generate the power saving signal having one of first through (t+1)-th values based on the comparison, t being an integer equal to or greater than 2.

5. The display driving device of claim 4, wherein the power management integrated circuit generates the drive voltage having a voltage level proportional to a value of the power saving signal.

6. The display driving device of claim 1, wherein:

the line buffer comprises first through s-th line buffers, s being an integer equal to or greater than 2;

the control circuit is configured to store the plurality of pixel data corresponding to consecutive first through s-th lines in the first through s-th line buffers, respectively;

the comparator is configured to compare each of first through s-th maximum magnitudes of the plurality of pixel data stored in the first through s-th line buffers, respectively, with a reference magnitude to generate first through s-th power saving signals; and wherein the display driving device comprises an AND gate configured to perform an AND operation on the first through s-th power saving signals to generate the power saving signal.

7. The display driving device of claim 1, wherein the column driver comprises:

a gamma voltage generation circuit configured to generate a plurality of gamma voltages;

a decoder configured to select one of the plurality of gamma voltages based on the plurality of pixel data, and to output the one of the plurality of gamma voltages; and an output buffer coupled between the drive voltage and a ground voltage, the output buffer being configured to receive the one of the plurality of gamma voltages as an input voltage and to generate the output voltage corresponding to the input voltage based on the drive voltage.

8. The display driving device of claim 7, wherein a maximum voltage level of the output voltage, which is generated by the output buffer, corresponds to a voltage level of the drive voltage provided to the output buffer.

9. The display driving device of claim 7, wherein the gamma voltage generation circuit is further configured to receive the power saving signal generated by the timing controller, and selectively stop generating at least one gamma voltage, which has a relatively high voltage level, among the plurality of gamma voltages based on the power saving signal.

10. The display driving device of claim 1, wherein the timing controller and the column driver are included in a same integrated circuit.

11. The display driving device of claim 1, wherein the timing controller and the column driver are included in separate integrated circuits.

12. A display driving device comprising:

a timing controller comprising a line buffer and a first comparator and a second comparator and configured to generate image data including a plurality of pixel data and store the plurality of pixel data corresponding to one line in the line buffer, to generate a positive power saving signal having one of first through (t+1)th positive values by comparing, by the first comparator, magnitudes of positive polarity pixel data among the plurality of pixel data included in the image data with each of first through t-th positive reference magnitudes, respectively, and generate the positive power saving signal having one of the first through t-th positive values, and to generate a negative power saving signal having one of first through (t+1)th negative values by comparing, by the second comparator, magnitudes of negative polarity pixel data among the plurality of pixel data included in the image data with each of first through t-th negative reference magnitudes, respectively, and generate the negative power saving signal having one of the first through t-th negative values;

a power management integrated circuit configured to generate a positive drive voltage having a voltage level that is varied based on the positive power saving signal, and to generate a negative drive voltage having a voltage level that is varied based on the negative power saving signal; and a column driver configured to receive the image data generated by the timing controller and the positive drive voltage and the negative drive voltage generated by the power management integrated circuit, to generate a plurality of positive output voltages corresponding to the positive polarity pixel data included in the image data based on the positive drive voltage, and to generate a plurality of negative output voltages corresponding to the negative polarity pixel data included in the image data based on the negative drive voltage.

13. The display driving device of claim 12, wherein the column driver comprises:

a gamma voltage generation circuit configured to generate a plurality of positive gamma voltages and a plurality of negative gamma voltages;

a positive decoder configured to select one of the plurality of positive gamma voltages as a selected positive gamma voltage based on the positive polarity pixel data included in the image data, and to output the selected positive gamma voltage;

a negative decoder configured to select one of the plurality of negative gamma voltages as a selected negative gamma voltage based on the negative polarity pixel data included in the image data, and to output the selected negative gamma voltage;

a positive output buffer coupled between the positive drive voltage and a ground voltage, the positive output buffer being configured to receive the selected positive gamma voltage as a positive input voltage and to generate the positive output voltage corresponding to the positive input voltage based on the positive drive voltage; and a negative output buffer coupled between the negative drive voltage and the ground voltage, the negative output buffer being configured to receive the selected negative gamma voltage as a negative input voltage and to generate the negative output voltage corresponding to the negative input voltage based on the negative drive voltage.

14. The display driving device of claim 13, wherein the gamma voltage generation circuit is further configured to receive the positive power saving signal and the negative power saving signal generated by the timing controller, and selectively stop generating at least one positive gamma voltage, which has a relatively high voltage level, among the plurality of positive gamma voltages based on the positive power saving signal, and selectively stop generating at least one negative gamma voltage, which has a relatively high voltage level, among the plurality of negative gamma voltages based on the negative power saving signal.

15. A display device comprising:

a display panel configured to display an image; and a display driving device configured to drive the display panel and coupled to the display panel via data lines and gate lines, the display driving device comprising:

a column driver configured to generate a plurality of output voltages corresponding to pixel data included in image data and to output the plurality of output voltages via the data lines, wherein the plurality of output voltages are varied according to a maximum magnitude of the pixel data; and a gate driver configured to select and drive the gate lines, wherein the display driving device further comprises:

a timing controller configured to generate the pixel data, and to generate a power saving signal based on magnitudes of the pixel data and a reference magnitude; and a power management integrated circuit configured to generate a drive voltage having a voltage level that is varied based on the power saving signal, wherein the column driver is further configured to receive the pixel data generated by the timing controller and the drive voltage generated by the power management integrated circuit, and to generate the plurality of output voltages corresponding to the pixel data based on the drive voltage, and wherein the timing controller comprises:

a line buffer;

a control circuit configured to divide the pixel data in a unit of a line and store the pixel data corresponding to one line in the line buffer; and a comparator configured to compare a maximum magnitude of the pixel data stored in the line buffer with the reference magnitude and generate the power saving signal based on the comparison.

16. The display device of claim 15, wherein the timing controller is further configured to:

deactivate the power saving signal when a maximum magnitude of the pixel data included is equal to or greater than the reference magnitude, and activate the power saving signal when the maximum magnitude of the pixel data is less than the reference magnitude, and wherein the power management integrated circuit is further configured to generate the drive voltage having a first voltage level when the power saving signal is deactivated, and generate the drive voltage having a second voltage level lower than the first voltage level when the power saving signal is activated.

17. The display device of claim 15, wherein the timing controller is further configured to compare a maximum magnitude of the pixel data with each of first through t-th reference magnitudes and generate the power saving signal having one of first through (t+1)-th values based on the comparison, t being an integer equal to or greater than 2, and wherein the power management integrated circuit generates the drive voltage having a voltage level proportional to a value of the power saving signal.

* * * * *